US006020102A

United States Patent [19]

Fujimoto et al.

[11] Patent Number: 6,020,102

[45] Date of Patent: Feb. 1, 2000

[54] POSITIVE-CHARGEABLE TONER, IMAGE FORMING METHOD AND APPARATUS UNIT

[75] Inventors: Masami Fujimoto; Hirohide Tanikawa, both of Shizuoka-ken; Tsutomu Onuma, Yokohama; Hiroyuki Fujikawa, Numazu, all of Japan

[73] Assignee: Canon Kabushiki Kaisha, Tokyo, Japan

[21] Appl. No.: 09/110,023

[22] Filed: Jul. 2, 1998

[30] Foreign Application Priority Data

Jul. 4, 1997 [JP] Japan ..... 9-178752

[51] Int. Cl.[7] ..... G03G 9/097; G03G 13/08; G03G 15/08

[52] U.S. Cl. ..... 430/110; 430/120; 399/252

[58] Field of Search ..... 430/110, 120; 399/252

[56] References Cited

U.S. PATENT DOCUMENTS

| | | | |
|---|---|---|---|
| 2,297,691 | 10/1942 | Carlson | 430/31 |
| 4,983,485 | 1/1991 | Nagaoka et al. | 430/110 |
| 5,098,811 | 3/1992 | Anno et al. | 430/110 |
| 5,102,765 | 2/1992 | McCabe et al. | 430/110 |
| 5,266,433 | 11/1993 | Ishida et al. | 430/110 |
| 5,389,484 | 2/1995 | Hagiwara et al. | 430/109 |
| 5,478,948 | 12/1995 | Schroeder et al. | 430/110 |

FOREIGN PATENT DOCUMENTS

| | | |
|---|---|---|
| 0340928 | 11/1989 | European Pat. Off. . |
| 0431930 | 6/1991 | European Pat. Off. . |
| 0619527 | 10/1994 | European Pat. Off. . |
| 0686882 | 12/1995 | European Pat. Off. . |
| 3931714 | 4/1990 | Germany . |
| 51-23354 | 7/1976 | Japan . |
| 55-90509 | 7/1980 | Japan . |
| 57-66455 | 4/1982 | Japan . |
| 57-178249 | 11/1982 | Japan . |
| 57-178250 | 11/1982 | Japan . |
| 60-4946 | 1/1985 | Japan . |
| 61-110115 | 5/1986 | Japan . |
| 61-110156 | 5/1986 | Japan . |
| 62-9256 | 1/1987 | Japan . |
| 63-214760 | 9/1988 | Japan . |
| 63-217362 | 9/1988 | Japan . |
| 63-217363 | 9/1988 | Japan . |
| 63-217364 | 9/1988 | Japan . |
| 2-168264 | 6/1990 | Japan . |
| 2-235069 | 9/1990 | Japan . |
| 3-71150 | 3/1991 | Japan . |
| 5-173363 | 7/1993 | Japan . |
| 5-173366 | 7/1993 | Japan . |
| 5-241371 | 9/1993 | Japan . |
| 8-010364 | 1/1996 | Japan . |

*Primary Examiner*—Roland Martin
*Attorney, Agent, or Firm*—Fitzpatrick, Cella, Harper & Scinto

[57] ABSTRACT

A positive-chargeable toner is disclosed which has a binder resin, a colorant and a charge control agent. The binder resin contains a styrene copolymer and has an acid value of from 0.5 to 50.0 mg KOH/g, and the charge control agent has an imidazole derivative represented by the Formula (1). Also, an image forming method and an apparatus unit, making use of the positive-chargeable toner, are disclosed.

102 Claims, 7 Drawing Sheets

POSITIVE-CHARGEABLE TONER, IMAGE FORMING METHOD AND APPARATUS UNIT

BACKGROUND OF THE INVENTION

1. Field of the Invention

This invention relates to a positive-chargeable toner used in recording processes such as electrophotography, electrostatic recording, magnetic recording and toner-jet recording, an image forming method having the step of developing an electrostatic latent image by the use of the toner, and an apparatus unit having the toner.

2. Related Background Art

A number of methods as disclosed in U.S. Pat. No. 2,297,691 and Japanese Patent Publication No. 42-23910 and No. 43-24748 are conventionally known as electrophotography. In general, copies are obtained by forming an electrostatic latent image on a photosensitive member by utilizing a photoconductive material and by various means, subsequently developing the latent image by the use of a toner, and transferring the toner image to a transfer medium such as paper as occasion calls, followed by fixing by the action of heat, pressure, heat-and-pressure, or solvent vapor. The toner not transferred and having remained on the photosensitive member is cleaned by various means, and then the above process is repeated.

In recent years, such copying apparatus, reflecting commercial needs for composite type machines and personal use, are severely sought to be made more small-sized, more light-weight, more high-speed and more highly reliable. As a result, a higher performance has become required also for toners.

For example, various methods and devices have been brought out in relation to the step of fixing a toner image to a transfer sheet such as paper. A method most commonly available at present is the heating pressure-fixing system using a heat roller. The heating pressure-fixing system using a heat roller is a method of fixing a toner image by causing the toner image on an image-receiving sheet to pass the surface of a heat roller whose surface is formed of a material having releasability to toner while the former is brought into contact with the latter under application of a pressure. Since in this method the surface of the heat roller comes into contact with the toner image of the image-receiving sheet under application of a pressure, a very good thermal efficiency can be achieved when the toner image is fixed onto the image-receiving sheet, so that the toner image can be fixed rapidly.

The heat-roll fixing having been hitherto widely used, however, is required to maintain the heat roller at an optimum temperature in order to prevent faulty fixing from being caused by the variations of the heat-roller temperature that may occur when the transfer medium is passed or because of other external factors, and also to prevent what is called the offset phenomenon in which the toner moves to the heat roller. This makes it necessary to make large the heat capacity of the heat roller or a heater element, which requires a large electric power and also requires a larger size of image forming apparatus or causes in-machine temperature rise.

Accordingly, for the purpose of causing no toner to adhere to the surface of the fixing roller or improving low-temperature fixing performance, measures have been proposed in variety. For example, the roller surface is formed of a material having an excellent releasability to toner (e.g., silicon rubber or fluorine resin) and, in order to prevent offset and to prevent fatigue of the roller surface, the roller surface is further covered with a thin film formed using a fluid having a good releasability as exemplified by silicone oil. However, this method, though very effective in view of the prevention of the offset of toner, requires a device for feeding an anti-offset fluid, and hence has also the problem that fixing assemblies must be made complicated and apparatus must be made large-sized.

Thus, in addition to such approaches from fixing assemblies, measures very greatly rely on the properties of toner in order to accomplish a fixing method having a good efficiency while achieving a good fixing performance of visible toner images to the transfer medium and good anti-offset properties.

Namely, especially from the viewpoint of anti-offset techniques, it is not a preferable measure to prevent the offset by feeding the anti-offset fluid. Rather, under existing circumstances, it is sought to further provide a toner having a broad low-temperature fixing range and high anti-offset properties. Accordingly, in order to improve release properties of the toner itself, it has been attempted to add a wax such as low-molecular-weight polyethylene or low-molecular-weight polypropylene that may well melt at the time of heating. The use of wax is effective for preventing offset, but on the other hand makes the toner have higher agglomerating properties and also makes charging performance unstable, to tend to cause a lowering of developing performance at the time of running. Accordingly, as other methods, it is also attempted to improve binder resins.

For example, a method is known in which, in order to prevent offset, the glass transition temperature (Tg) and molecular weight of a binder resin in toner are made higher to improve the melt viscoelasticity of the toner. When, however, the anti-offset properties are improved by such a method, although the developing performance is not so affected, an insufficient fixing performance may result to cause the problem of poor fixing performance in low-temperature fixing, i.e., low-temperature fixing performance, which is required for the achievement of high-speed copying and energy saving.

In order to improve the low-temperature fixing performance of toner, it is necessary to make the toner have a low viscosity at the time of its melting and make large the area of contact with a fixing member. For this reason, it is required to make lower the Tg and molecular weight of binder resins used.

That is, the low-temperature fixing performance and the anti-offset properties conflict with each other in some phase, and hence it is very difficult to provide toners satisfying these performances simultaneously.

To solve this problem, for example, a toner comprising a vinyl polymer cross-linked to an appropriate degree by adding a cross-linking agent and a molecular-weight modifier is proposed, as disclosed in Japanese Patent Publication No. 51-23354. Also, toners comprising a blend type resin vinyl polymer in which Tg, molecular weight and gel content are specified in combination are also proposed in a large number.

Such toners incorporated with the cross-linked vinyl polymer or gel content show an excellent effect on the anti-offset properties. However, when such a cross-linked vinyl polymer is used as a toner material to incorporate it in the toner, the polymer may undergo a very great internal friction in the step of melt kneading when the toner is produced, and a great shear force is applied to the polymer. Hence, in most cases, breaking of molecular chains may occur to cause a decrease in melt viscosity to adversely affect the anti-offset properties.

Accordingly, to solve this problem, as disclosed in Japanese Patent Application Laid-open No. 55-90509, No. 57-178249, No. 57-178250 and No. 60-4946, it is disclosed to use as toner materials a resin having a carboxylic acid and a metal compound, which are heated and reacted at the time of melt-kneading to form a cross-linked polymer and incorporate it in the toner.

Japanese Patent Application Laid-open No. 61-110155 and No. 61-110156 disclose that a binder having as essential constituents a vinyl resin monomer and a special monoester compound is allowed to react with a polyvalent metal compound to effect cross-linking through a metal.

Japanese Patent Application Laid-open No. 63-214760, No. 63-217362, No. 63-217363 and No. 63-217364 disclose that a binder resin has a molecular weight distribution separated into two groups, a low-molecular weight region and a high-molecular weight region, and carboxylic acid groups incorporated into the low-molecular weight region side are allowed to react with polyvalent metal ions to effect cross-linking (a dispersion of a metal compound is added in a solution obtained by solution polymerization, followed by heating to carry out the reaction).

Japanese Patent Application Laid-open No. 2-168264, No. 2-235069, No. 5-173363, No. 5-173366 and No. 5-241371 disclose toner binder resin compositions and toners in which the molecular weights, mixing ratio, acid values and percentages of low-molecular weight components and high-molecular weight components in binder resins are controlled to improve fixing performance and anti-offset properties.

Japanese Patent Application Laid-open No. 62-9256 discloses a toner binder resin composition comprising a blend of two kinds of vinyl resins having different molecular weights and acid values of resin.

These proposals set forth in the foregoing can certainly be very effective in respect of the improvement in anti-offset properties, though having merits and demerits. These, however, require introduction of acid value into toner binders, and hence negative chargeability is necessarily imparted to toners, though having more or less differences. As the result, when applied in positive-chargeable toners, their charging performance at the rise of toner charging, during running and in an environment of high humidity or low humidity may be greatly damaged to cause a lowering of developing performance concerning image density and fog. Moreover, they can not stably retain a proper charge quantity to make toner agglomeration properties higher, and have not attained satisfactory results.

Meanwhile, toners must have positive or negative charges in accordance with the charge polarity of electrostatic latent images to be developed, and hence it is commonly known to add dyes, pigments or charge control agents to toners. Among these, as positive charge control agents, it is known to use quaternary ammonium salts or lake pigments of these, polymers having a tertiary amino group or quaternary ammonium salt in the side chain, triphenylmethane dyes and lake pigments of these, Nigrosine, and products modified with fatty acid metals salts.

These conventional positive charge control agents, however, have tended to be not able to impart sufficient charge quantity to toners, or, if they are able to impart sufficient charge quantity, tended to be affected by other constituent materials of toner to cause occurrence of blotches due to excessive triboelectricity of toner or non-uniform charging, or make toners have higher agglomerating properties, or cause deterioration of developing performance, e.g., image density decrease and fog. This tendency is especially remarkable in positive-chargeable toners having an acid value. Moreover, there has been a problem of sleeve contamination which is caused when the charge control agent comes off toner particles to stick to the surface of the developing sleeve, a developer carrying member.

Japanese Patent Publication No. 8-10364 discloses a positive-chargeable toner suited for not only black printing but also color printing, containing 4,4'-methylene-bis(2-alkyl-5-methylimidazole), which is white or pale and also has a high charge control effect by its addition in a small quantity. However, in the toner disclosed in Japanese Patent Publication No. 8-10364, no improvement has been achieved in respect of the improvement in fixing performance of the toner, and the binder resin specifically used in Examples is a styrene-acrylate copolymer. Taking account of the fixing performance of toner, there is room for further improvement.

Japanese Patent Application Laid-open No. 3-71150 discloses that a positive-chargeable toner containing a polyester resin having a softening point of from 70 to 150° C. and an acid value of 5 mg KOH/g or less, synthesized from a diol and a polybasic carboxylic acid, and also containing a specific imidazole derivative has a stable triboelectric charging performance and a sharp and uniform distribution of quantity of triboelectricity, enables development and transfer faithful to latent images, can maintain initial-stage characteristics even when continuously used over a long period of time, may cause no agglomeration of toner and no change in charging performance, and also may not be affected by changes in temperature and humidity to reproduce stable images. However, the toner disclosed in Japanese Patent Application Laid-open No. 3-71150 employs as a binder resin a polyester having relatively a large environmental dependence and negative chargeability, and hence its anti-offset properties may lower when its acid value is made small taking account of the environmental dependence and the charging stability of positive-chargeable toner. Moreover, in this case, since many of the hydroxy groups are left, the toner may largely be affected by changes in humidity in a high humidity. The toner is hardly affected by humidity when used in the two-component developing system, so that serious problem does not occur at all, while the toner is liable to be affected by humidity when used in the one-component developing system. Thus, this toner can not achieve a highly well balanced state of the anti-offset properties, environmental stability and positive charging performance, and there is room for further improvement.

From another aspect, there is a problem of how proper charging can be maintained stably for a long term and in a good efficiency in an instance where a toner is brought into contact with the developing sleeve, the developer carrying member, to triboelectrically charge the toner.

As the developing sleeve in an image forming apparatus employing electrophotography, a member is used which is produced by molding, e.g., a metal or an alloy or compound thereof into a cylinder and treating its surface by electrolysis, blasting or filing so as to have a stated surface roughness. As commonly available substrate materials for the developing sleeve, stainless steel, aluminum and nickel are in wide use, which are disclosed in Japanese Patent Application Laid-open No. 57-66455.

When, however, the positive-chargeable toner is charged using such a developing sleeve, it is difficult to control the charge quantity of toner. For example, when a stainless steel sheet is used as the sleeve substrate material, the developing sleeve has so strong a charge-providing power that the toner present in the vicinity of the sleeve surface may acquire very high charges, so that the toner is strongly attracted to the sleeve surface because of mirror force to undesirably form an immobile layer. This lessens opportunities of friction of the toner with the developing sleeve to inhibit preferable charging. As the result, non-uniform charging of toner or blotches due to excessive charging tend to occur and, of course, developing performance may also deteriorate.

When aluminum is used as the sleeve substrate material, the developing sleeve has a high ability to charge the positive-chargeable toner. However, because of a softness inherent in the material, it has a poor durability and tends to cause image deterioration due to surface wear. Accordingly, in order to endow it with wear resistance, the surface of the aluminum substrate is coated or plated with a metal. Such a technique can improve the hardness of the sleeve surface to make the durability better, but on the other hand most of such sleeves have a low ability to charge the positive-chargeable toner, tending to cause faulty charging of toner.

Similarly, a developing sleeve on the substrate material surface of which is provided with a resin layer has a good durability, but has a limit to the controlling of charge-providing performance to the toner. It has a broad range of application in respect of negative charging, but, when applied in positive charging, can not be endowed with a suitable charge-providing ability. Under existing circumstances, especially when the binder resin has an acid value, it is difficult to charge the toner.

SUMMARY OF THE INVENTION

An object of the present invention is to provide a positive-chargeable toner that can solve the problems discussed above, and an image forming method and an apparatus unit which make use of such a positive-chargeable toner.

Another object of the present invention is to provide a positive-chargeable toner that has superior anti-offset properties, can obtain a blotch-free uniform coat layer on the developer carrying member, has a high running performance and can achieve a stable image density and a low fog, i.e., can long-term stably promise good image characteristics; and an image forming method and an apparatus unit which make use of such a positive-chargeable toner.

To achieve the above objects, the present invention provides a positive-chargeable toner comprising a binder resin, a colorant and a charge control agent, wherein;

the binder resin contains a styrene copolymer and has an acid value of from 0.5 to 50.0 mg KOH/g; and the charge control agent has an imidazole derivative represented by the following Formula (1):

(1)

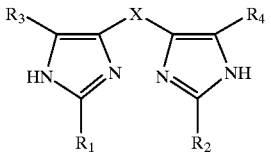

wherein $R_1$, $R_2$, $R_3$ and $R_4$ each represent a substituent selected from the group consisting of a hydrogen atom, an alkyl group, an aralkyl group and an aryl group, which are the same or different from one another and may further be substituted with a substituent; and X represents a connecting group selected from the group consisting of a phenylene group, a propenylene group, a vinylene group, an alkylene group and —$CR_5R_6$—, where $R_5$ and $R_6$ each represent a substituent selected from the group consisting of a hydrogen atom, an alkyl group, an aralkyl group and an aryl group.

The present invention also provides an image forming method comprising the steps of;

forming an electrostatic latent image on an electrostatic latent image bearing member; and developing the electrostatic latent image by the use of a one-component developer having a positive-chargeable toner, carried and transported on the surface of a developer carrying member;

the developer carrying member having at least a surface formed of a material containing a resin; and the positive-chargeable toner comprising a binder resin, a colorant and a charge control agent, wherein;

the binder resin contains a styrene copolymer and has an acid value of from 0.5 to 50.0 mg KOH/g; and the charge control agent has an imidazole derivative represented by the following Formula (1):

(1)

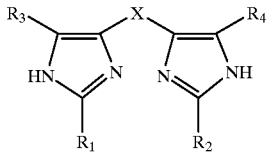

wherein $R_1$, $R_2$, $R_3$ and $R_4$ each represent a substituent selected from the group consisting of a hydrogen atom, an alkyl group, an aralkyl group and an aryl group, which are the same or different from one another and may further be substituted with a substituent; and X represents a connecting group selected from the group consisting of a phenylene group, a propenylene group, a vinylene group, an alkylene group and —$CR_5R_6$—, where $R_5$ and $R_6$ each represent a substituent selected from the group consisting of a hydrogen atom, an alkyl group, an aralkyl group and an aryl group.

The present invention still also provides an apparatus unit detachably mountable on a main assembly of an image forming apparatus; the unit comprising;

a one-component developer having at least a positive-chargeable toner;

a developer container for holding the one-component developer; and a developer carrying member for carrying the one-component developer held in the developer container and transporting the developer to a developing zone;

the developer carrying member having at least a surface formed of a material containing a resin; and the positive-chargeable toner comprising a binder resin, a colorant and a charge control agent, wherein;

the binder resin contains a styrene copolymer and has an acid value of from 0.5 to 50.0 mg KOH/g; and the charge control agent has an imidazole derivative represented by the following Formula (1):

(1)

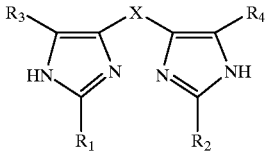

wherein $R_1$, $R_2$, $R_3$ and $R_4$ each represent a substituent selected from the group consisting of a hydrogen atom, an alkyl group, an aralkyl group and an aryl group, which are the same or different from one another and may further be substituted with a substituent; and X represents a connecting group selected from the group consisting of a phenylene group, a propenylene group, a vinylene group, an alkylene group and —$CR_5R_6$—, where $R_5$ and $R_6$ each represent a substituent selected from the group consisting of a hydrogen atom, an alkyl group, an aralkyl group and an aryl group.

BRIEF DESCRIPTION OF THE DRAWINGS

FIG. 2A is a view before its polishing, and FIG. 2B a view after its polishing.

DESCRIPTION OF THE PREFERRED EMBODIMENTS

Figure 1:
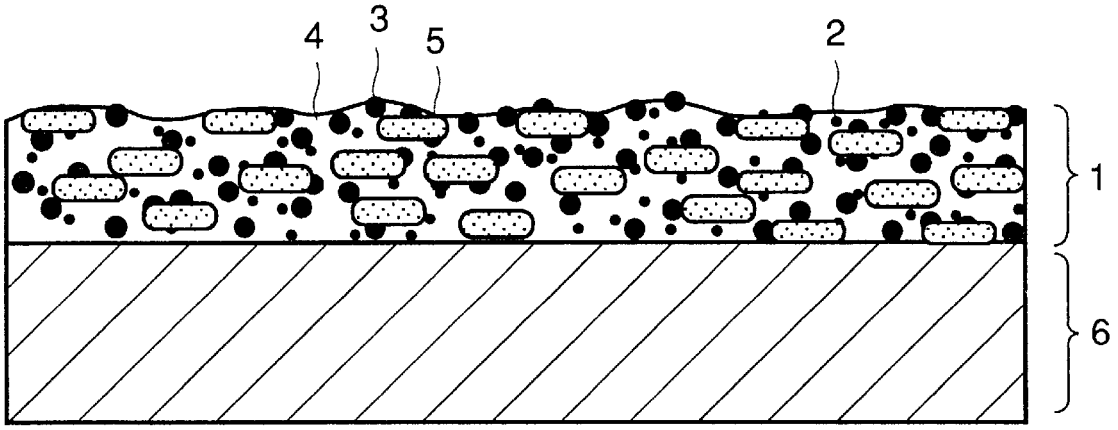
FIG. 1 is a partial schematic cross-sectional view of a developer carrying member according to the present invention.

The present inventors have discovered that good anti-offset properties can be achieved without damaging the charging performance and powder characteristics required as positive-chargeable toners when a toner binder resin containing a styrene copolymer is made to have an acid value of from 0.5 to 50.0 mg KOH/g and a specific imidazole derivative described below is used as a charge control agent. Especially when a member comprising a metal substrate and a coat layer formed on the metal substrate and containing a resin is used as a developing sleeve (developer carrying member) with which the toner is triboelectrically charged, better charge-providing performance can be attained and also proper charging can be long-term stably maintained, so that a superior developing performance can be maintained.

The following description will elucidate the reason why such effect can be produced in the present invention.

In the toner containing the binder resin containing a styrene copolymer and having a specific acid value, an imidazole derivative represented by the following Formula (1) is used as the charge control agent.

(1)

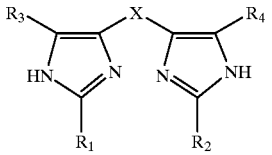

wherein $R_1$, $R_2$, $R_3$ and $R_4$ each represent a substituent selected from the group consisting of a hydrogen atom, an alkyl group, an aralkyl group and an aryl group, which are the same or different from one another and may further be substituted with a substituent; and X represents a connecting group selected from the group consisting of a phenylene group, a propenylene group, a vinylene group, an alkylene group and —$CR_5R_6$—, where $R_5$ and $R_6$ each represent a substituent selected from the group consisting of a hydrogen atom, an alkyl group, an aralkyl group and an aryl group.

Use of such an imidazole derivative has proved to bring about an excellent performance that the toner has a uniform triboelectric charging performance, and has a sufficient triboelectric chargeability on the one hand and restrains excessive charging on the other hand even in the case of positive-chargeable toners containing a styrene copolymer in which a carboxyl group has been introduced. The mechanism by which the toner can be restrained from its excessive charging has not been made clear at present, and it is presumed that some mutual action takes place between the styrene copolymer having a monomer unit containing a carboxyl group and the specific imidazole derivative. At any event, since the toner can be restrained from its excessive charging, it becomes possible to prevent blotches from occurring and toner agglomerating properties from becoming higher.

The toner containing the imidazole derivative represented by the above Formula (1) undergoes less variations in chargeability even in an environment of high humidity or low humidity and can retain stable developing performance. At the same time, the use of the styrene copolymer having a monomer unit containing a carboxyl group makes the specific imidazole derivative less come off toner particles, and hence the occurrence of sleeve contamination can be restrained.

The reason why the imidazole derivative can be restrained from coming off toner particles is presumed to be due to a mutual action between a secondary amine present in the specific imidazole compound and carboxyl groups present in the styrene copolymer.

The positive-chargeable toner of the present invention exhibits a good triboelectric charging performance in the process of triboelectric charging with the developer carrying member also when a commonly available stainless steel or aluminum or metal coating is used as a material for the developer carrying member. In addition, it has been found that this toner exhibits much superior positive charging performance even in its contact with a developer carrying member on which a coat layer containing a resin has been formed.

Positive-chargeable toners containing a conventionally known, usual charge control agent as exemplified by Nigrosine are known to exhibit a good positive charging performance in their contact with stainless steel. When such a positive-chargeable toner is brought into contact with a developer carrying member having on its surface a coat layer containing a resin (e.g., a coat layer containing a resin with carbon black dispersed therein), the toner has a slightly low positive charging performance, and has a still lower charging performance in the instance where the binder resin has an acid value.

On the other hand, in the case when the specific imidazole derivative used in the toner of the present invention is used as the charge control agent, the toner exhibits a good charging performance also in its contact with stainless steel, but exhibits much superior charging performance when brought into contact with a developer carrying member, at least the surface of which is formed of a material containing a resin. It has been found that this tendency is especially remarkable when the binder resin has an acid value and the toner exhibits a much higher charging performance than the case when brought into contact with stainless steel.

As the result, the toner can be improved in developing performance, and can form high-grade images with a high image density and less fog even after running on many sheets.

The toner binder resin containing a styrene copolymer, used in the present invention, may have an acid value of from 0.5 to 50 mg KOH/g, preferably from 0.5 to 30 mg KOH/g, more preferably from 0.5 to 20 mg KOH/g, still more preferably from 2.0 to 20 mg KOH/g, and yet more preferably from more than 5.0 mg KOH/g to not more than 20 mg KOH/g.

If the binder resin has an acid value less than 0.5 mg KOH/g, the toner can not well exhibit the effect of preventing offset, the developing stability attributable to the mutual action with the imidazole derivative and the effect of preventing sleeve contamination. If it has an acid value more than 50 mg KOH/g, the toner binder resin may have so strong a negative chargeability as to tend to cause a decrease in image density and an increase in fog.

In the present invention, the acid value (JIS acid value) of the toner binder resin is determined in the following way.

Measurement of Acid Value

The basic procedure for the measurement is carried out in accordance with JIS K-0070.

1) A sample from which additives other than the binder resin have been removed is used. Alternatively, the acid value and content of additives other than the binder resin are previously determined. A pulverized product of the sample is weighed in an amount of from 0.5 to 2.0 g, and its weight is represented by W (g).

2) The sample is put in a 300 ml beaker, to which 150 ml of a toluene/ethanol (4/1) mixed solvent is added to dissolve the sample.

3) The solution formed is titrated with an ethanol solution of 0.1N KOH by means of a potential difference titration unit (e.g., automatic titration using a potential difference titration unit AT-400 (Win Workstation), manufactured by Kyoto Denshi K. K., and a motor-driven burette ABP-410 may be utilized.)

4) The amount of the KOH solution used in this titration is represented by S (ml). A blank is also measured, and the amount of the KOH solution used in this measurement is represented by B (ml).

5) The acid value (mg KOH/g) is calculated according to the following expression.

$$\text{Acid value}=\{(S-B)\times f\times 5.61\}/W \text{ (f: factor of KOH)}$$

In the styrene copolymer the binder resin of the toner of the present invention has, the monomer containing a carboxyl group or acid anhydride group, used to adjust the acid value and with which the styrene monomer is copolymerized, may include, e.g., acrylic acid and α-or β-alkyl derivatives thereof such as acrylic acid, methacrylic acid, α-ethylacrylic acid, crotonic acid, cinnamic acid, vinyl acetate, isocrotonic acid and angelic acid; and unsaturated dicarboxylic acids and monoester derivatives or anhydrides thereof such as fumaric acid, maleic acid, citraconic acid, alkenyl succinates, itaconic acid, mesaconic acid, dimethyl maleate and dimethyl fumarate. These monomers are each used alone or in combination and is polymerized with a styrene monomer. Among these, the use of monoester derivatives of unsaturated dicarboxylic acids is especially preferred because the value of acid value can be controlled with ease.

Such derivatives may specifically include monoesters of α,β-unsaturated dicarboxylic acids as exemplified by monomethyl maleate, monoethyl maleate, monobutyl maleate, monooctyl maleate, monoallyl maleate, monophenyl maleate, monomethyl fumarate, monoethyl fumarate, monobutyl fumarate and monophenyl fumarate; and monoesters of alkenyl dicarboxylic acids as exemplified by monobutyl n-butenyl succinate, monomethyl n-octenyl succinate, monoethyl n-butenyl malonate, monomethyl n-dodecenyl glutarate and monobutyl n-butenyl adipate.

Any of the carboxyl group or acid anhydride group-containing monomers as shown above may be added in an amount of from 0.1 to 20 parts by weight, and preferably from 0.2 to 15 parts by weight, based on 100 parts by weight of the whole monomers constituting the binder resin.

The reason why the monoester monomers of dicarboxylic acids as shown above are selected is that these may preferably be used in the form of esters having a low solubility in aqueous suspensions and having a high solubility in organic solvents or other monomers.

In the present invention, the styrene monomer with which the above carboxyl group or acid anhydride group-containing monomer is copolymerized may include, in addition to styrene monomers, styrene derivative monomers such as o-methylstyrene, m-methylstyrene, p-methylstyrene, p-methoxystyrene, p-phenylstyrene, p-chlorostyrene, 3,4-dichlorostyrene, p-ethylstyrenee, 2,4-dimethylstyrene, p-n-butylstyrene, p-tert-butylstyrene, p-n-hexylstyrene, p-n-octylstyrene, p-n-nonylstyrene, p-n-decylstyrene and p-n-dodecylstyrene.

The styrene copolymer used in the present invention may be obtained by copolymerizing the styrene monomer with other vinyl monomer.

Such other vinyl monomer may include, e.g., ethylene unsaturated monoolefins such as ethylene, propylene, butylene and isobutylene; unsaturated polyenes such as butadiene and isoprene; vinyl halides such as vinyl chloride, vinylidene chloride, vinyl bromide and vinyl fluoride; vinyl esters such as vinyl acetate, vinyl propionate and vinyl benzoate; α-methylene aliphatic monocarboxylates such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate and diethylaminoethyl methacrylate; acrylic esters such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate and phenyl acrylate; vinyl ethers such as methyl vinyl ether, ethyl vinyl ether and isobutyl vinyl ether; vinyl ketones such as methyl vinyl ketone, hexyl vinyl ketone and methyl isopropenyl ketone; N-vinyl compounds such as N-vinylpyrrole, N-vinylcarbazole, N-vinylindole and N-vinylpyrrolidone; vinylnaphthalenes; and acrylic acid or methacrylic acid derivatives such as acrylonitrile, methacrylonitrile and acrylamide. Any of these vinyl monomers may be used alone or in combination of two or more monomers.

Of these other vinyl, acrylate monomers are particularly preferred in view of the fixing performance.

In the present invention, the carboxylic acid groups, acid anhydride groups and carboxylate ester moieties in the styrene copolymers obtained in the manner as described above may be subjected to an alkali treatment to effect saponification. More specifically, they may be made to react with cationic components of an alkali so that the carboxylic acid groups or carboxylate moieties are converted into polar functional groups.

This alkali treatment may be made after the production of the styrene copolymer, by introducing an alkali in the form of an aqueous solution into the solvent used in polymerization, and while stirring the mixture. The alkali that can be used in the present invention may include hydroxides of alkali metals or alkaline earth metals such as Na, K, Ca, Li, Mg and Ba; hydroxides of transition metals such as Zn, Ag, Pb and Ni; and hydroxides of quaternary ammonium salts such as ammonium salts, alkali ammonium salts and pyridinium salts. As particularly preferred examples, it may include NaOH and KOH.

In the present invention, the above saponification may be not necessarily effected over all the carboxylic acid groups, acid anhydride groups and carboxylate moieties in the styrene copolymer, and the saponification may proceed in part to convert some of them into polar functional groups.

The amount of the alkali used in the reaction of saponification depends on the type of the polar groups in the styrene copolymer, the manner of dispersion and the type of component monomers, and is difficult to absolutely determine. It may be in 0.02- to 5-fold equivalent weight of the acid value of the binder resin. If it is more than 5-fold equivalent weight, the functional groups at, e.g., the carboxylate ester moieties tend to be adversely affected because of the formation of salts as a result of dehydration of esters or saponification reaction.

When the alkali treatment is made in the amount of 0.02- to 5-fold equivalent weight of the acid value, the cations remaining after the treatment can be in a concentration within the range of from 5 to 1,000 ppm, and may preferably be used to define the amount of the alkali.

The binder resin containing the styrene copolymer used in the present invention may preferably contain a resin composition which is a mixture of a high-molecular-weight polymer component and a low-molecular-weight polymer component.

In such an instance, in view of mixing properties, both the low-molecular-weight polymer component and the high-molecular-weight polymer component may preferably each contain the styrene copolymer component in an amount not less than 65% by weight.

This resin composition may be prepared by methods including a solution blend method in which the high-molecular-weight polymer component and the low-molecular-weight polymer component are separately synthesized by solution polymerization or suspension polymerization and thereafter these are mixed in the state of a solution, followed by solvent removal; a dry blend method in which the high-molecular-weight polymer component and the low-molecular-weight polymer component are separately synthesized by solution polymerization or suspension polymerization, followed by washing and drying (i.e., solvent removal), and thereafter these are melt-kneaded by means of an extruder; and a two-stage polymerization method in which a low-molecular-weight polymer obtained by solution polymerization is dissolved in monomers constituting the high-molecular-weight polymer component to carry out suspension polymerization to synthesize the high-molecular-weight polymer, followed by washing and drying to obtain a resin composition. The dry blend method, however, has a problem in respect of uniform dispersion and compatibilization. The two-stage polymerization method has many advantages in respect of uniform dispersion and so forth. However, compared with this two-stage polymerization method, the solution blend method is most preferred because the low-molecular-weight polymer component can be made more than the high-molecular-weight polymer component, the high-molecular-weight polymer component having a larger molecular weight can be synthesized, and has less problem that an unnecessary low-molecular-weight polymer component is formed as a by-product.

As a method for introducing the stated acid value into the low-molecular-weight polymer component, solution polymerization is preferred, which enables easier setting of acid value than aqueous polymerization.

Organic solvents used in the present invention when the solutions for the resin composition are mixed may include hydrocarbon type solvents such as benzene, toluene, xylene, solvent naphtha No. 1, solvent naphtha No. 2, solvent naphtha No. 3, cyclohexane, ethylbenzene, Solvesso 100, Solvesso 150 and mineral spirits; alcohol type solvents such as methanol, ethanol, iso-propyl alcohol, n-butyl alcohol, sec-butyl alcohol, iso-butyl alcohol, amyl alcohol and cyclohexanol; ketone type solvents such as acetone, methyl ethyl ketone, methyl isobutyl ketone and cyclohexanone; ester type solvents such as ethyl acetate, n-butyl acetate and cellosolve acetate; and ether type solvents such as methyl cellosolve, ethyl cellosolve, butyl cellosolve and methyl carbitol. Of these, aromatic solvents, ketone type solvents or ester type solvents are preferred. Some of these may be used in combination without any difficulty.

As methods for removing the organic solvent, it is preferable to use a method in which the organic solvent solution of polymers is heated, thereafter 10 to 80% by weight of the organic solvent is removed under normal pressure and then the remaining solvent is removed under reduced pressure. During this operation, the organic solvent solution may preferably be kept in the range of from the boiling point of the organic solvent used, to 200° C. If its temperature is lower than the boiling point of the organic solvent, not only the solvent is removed in a poor efficiency, but also an unwanted shear may be applied to the polymers dissolved in the organic solvent or the redispersion of the respective constituent polymers may be accelerated to cause phase separation in a microscopic state. Also, a temperature higher than 200° C. is not preferable since the polymers tend to undergo depolymerization, oligomers tend to be formed as a result of molecular break and impurities tend to mix into the resin composition.

The resin composition used in the present invention may preferably have a glass transition temperature (Tg) of from 45 to 80° C., and preferably from 50 to 70° C., from the viewpoint of storage stability. If the Tg is lower than 45° C., the toner tends to deteriorate in an environment of high temperature and the offset tends to occur at the time of fixing. If the Tg is higher than 80° C., the fixing performance tends to lower.

As a method for synthesizing the high-molecular-weight polymer of the resin composition used in the present invention may include solution polymerization, emulsion polymerization and suspension polymerization.

Of these, the emulsion polymerization is a method in which monomers almost insoluble in water are dispersed with an emulsifying agent in an aqueous phase in the form of small particles to carry out polymerization in the presence of a water-soluble polymerization initiator. This polymerization method enables easy control of reaction heat, and requires only a small rate of termination reaction since the phase where the polymerization is carried out (an oily phase formed of polymers and monomers) is separate from the aqueous phase, so that a product with a high polymerization concentration and a high degree of polymerization can be obtained. Moreover, since the polymerization process is relatively simple and the polymerization product is in the form of fine particles, colorants, charge control agents and other additives can be mixed with ease when the toner is produced. For such reasons, it has some advantageous points as a method for producing the toner binder resin.

However, the polymer tends to become impure because of the emulsifying agent added, and an operation such as salting-out is required to take out the polymer. In order to avoid such difficulties, the suspension polymerization is advantageous.

In the suspension polymerization, the reaction may preferably be carried out using monomers in an amount of not more than 100 parts by weight, and preferably from 10 to 90 parts by weight, based on 100 parts by weight of an aqueous solvent. Usable dispersants include polyvinyl alcohol, partially saponified polyvinyl alcohol and calcium phosphate, any of which may be used usually in an amount of from 0.05 to 1 part by weight based on 100 parts by weight of the aqueous solvent. Polymerization temperature may be from 50 to 95° C. as a suitable range, and may be appropriately selected depending on the initiator used and the intended polymer.

In order to achieve the object of the present invention, the high-molecular-weight polymer in the resin composition used in the present invention may preferably be synthesized using a polyfunctional polymerization initiator alone or in combination with a monofunctional polymerization initiator which are as exemplified below.

As a polyfunctional polymerization initiator having a polyfunctional structure, it may include polyfunctional polymerization initiators having in the molecule two or more functional groups such as peroxide groups, having a polymerization initiating function, as exemplified by 1,1-di-t-butylperoxy-3,3,5-trimethylcyclohexane, 1,3-bis(t-butylperoxyisopropyl)benzene, 2,5-dimethyl-2,5-(t-butylperoxy)hexane, 2,5-dimethyl-2,5-di-(t-butylperoxy)hexane, tris-(t-butylperoxy)triazine, 1,1-di-t-butylperoxycyclohexane, 2,2-di-t-butylperoxybutane, 4,4-di-t-butylperoxyvaleric acid-n-butyl ester, di-t-butylperoxyhexahydroterephthalate, di-t-butylperoxyazelate, di-t-butylperoxytrimethyladipate, 2,2-bis(4,4-di-t-butylperoxycyclohexyl)propane, 2,2-di-t-butylperoxyoctane, and various polymer oxides;

and polyfunctional polymerization initiators having in the molecule both a functional group such as a peroxide group, having a polymerization initiating function, and a polymerizable unsaturated group, as exemplified by diallylperoxydicarbonate, t-butylperoxymaleate, t-butylperoxyallylcarbonate, and t-butylperoxyisopropylfumarate.

Of these, more preferred ones are 1,1-di-t-butylperoxy-3,3,5-trimethylcyclohexane, 1,1-di-t-butylperoxycyclohexane, di-t-butylperoxyhexahydroterephthalate, di-t-butylperoxyazelate, 2,2-bis(4,4-di-t-butylperoxycyclohexyl)propane, and t-butylperoxyallylcarbonate.

In order to satisfy various performances required as binders for the toner, any of these polyfunctional polymerization initiators may preferably be used in combination with a monofunctional polymerization initiator. In particular, they may preferably be used in combination with a polymerization initiator having a half-life of 10 hours which is lower than the decomposition temperature necessary for the polyfunctional polymerization initiator to obtain a half-life of 10 hours.

Such a monofunctional polymerization initiator may include, e.g., organic peroxides such as benzoyl peroxide, 1,1-di(t-butylperoxy)-3,3,5-trimethylcyclohexane, n-butyl-4,4-di(t-butylperoxy)valerate, dicumyl peroxide, α, α'-bis(t-butylperoxydiisopropyl)benzene, t-butylperoxycumene, and di-t-butyl peroxide; and azo or diazo compounds such as azobisisobutyronitrile and diazoaminoazobenzene.

Any of these monofunctional polymerization initiators may be added in the monomers at the same time the polyfunctional polymerization initiator is added. However, in order to keep a proper efficiency of the polyfunctional polymerization initiator, the monofunctional polymerization initiator may preferably be added after the half-life shown by the polyfunctional polymerization initiator has lapsed.

In view of efficiency, any of these polymerization initiators may preferably be used in an amount of from 0.05 to 2 parts by weight based on 100 parts by weight of the monomers.

In order to well achieve the object of the present invention, the high-molecular-weight polymer component may preferably have been cross-linked with a cross-linkable monomer as exemplified below.

As the cross-linkable monomer, a monomer having at least two polymerizable double bonds may be used. As specific examples, it may include aromatic divinyl compounds as exemplified by divinylbenzene and divinylnaphthalene; diacrylate compounds linked with an alkyl chain, as exemplified by ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, and the above compounds whose acrylate moiety has been replaced with methacrylate; diacrylate compounds linked with an alkyl chain containing an ether bond, as exemplified by diethylene glycol diacrylate, triethylene glycol diacrylate, tetraethylene glycol diacrylate, polyethylene glycol #400 diacrylate, polyethylene glycol #600 diacrylate, dipropylene glycol diacrylate, and the above compounds whose acrylate moiety has been replaced with methacrylate; diacrylate compounds linked with a chain containing an aromatic group and an ether bond, as exemplified by polyoxyethylene(2)-2,2-bis(4-hydroxyphenyl)propane diacrylate, polyoxyethylene(4)-2,2-bis(4-hydroxyphenyl) propane diacrylate, and the above compounds whose acrylate moiety has been replaced with methacrylate; and also polyester type diacrylate compounds as exemplified by MANDA (trade name; available from Nippon Kayaku Co., Ltd.). Polyfunctional cross-linking agents may include pentaerythritol acrylate, trimethylolethane triacrylate, trimethylolpropane triacrylate, tetramethylolpropane triacrylate, tetramethylolmethane tetraacrylate, oligoester acrylate, and the above compounds whose acrylate moiety has been replaced with methacrylate; triallyl cyanurate, and triallyl trimellitate.

Any of these cross-linkable monomers may preferably be used in an amount of 1 part by weight or less, and preferably from 0.001 to 0.05 part by weight, based on 100 parts by weight of other monomer components.

Of these cross-linkable monomers, monomers preferably usable in view of the fixing performance and anti-offset properties of the toner are aromatic divinyl compounds (in particular, divinylbenzene) and diacrylate compounds linked with a chain containing an aromatic group and an ether bond.

As methods for synthesizing the low-molecular-weight polymer component of the resin composition, known methods may be used. In bulk polymerization, polymers with a low-molecular weight can be obtained by polymerizing monomers at a high temperature and accelerating the rate of termination reaction, but there is the problem of a difficulty in controlling the reaction. In this regard, in solution polymerization, the low-molecular-weight polymers can be obtained with ease under mild conditions by utilizing a difference in chain transfer of radicals that is caused by a solvent, or by controlling the quantity of initiators and the reaction temperature. Thus, this method is particularly preferred in order to obtain the low-molecular-weight polymer of the resin composition used in the present invention. Especially in view of controlling to a minimum the quantity of initiators used and preventing as far as possible any adverse effect caused by the initiator remaining in the resin composition, solution polymerization carried out under application of pressure is also preferred.

In the binder resin used in the toner of the present invention, in addition to the copolymer of a styrene monomer with a carboxyl group or acid anhydride group-containing monomer, the following resin may also be used in combination.

Such usable polymer may include, e.g., homopolymers of styrene and derivatives thereof such as polystyrene, poly-p-chlorostyrene and polyvinyl toluene; styrene copolymers such as a styrene-p-chlorostyrene copolymer, a styrene-vinyltoluene copolymer, a styrene-vinylnaphthalene copolymer, a styrene-acrylate copolymer, a styrene-methacrylate copolymer, a styrene-methyl α-chloromethacrylate copolymer, a styrene-acrylonitrile copolymer, a styrene-methyl vinyl ether copolymer, a styrene-ethyl vinyl ether copolymer, a styrene-methyl vinyl ketone copolymer, a styrene-butadiene copolymer, a styrene-isoprene copolymer and a styrene-acrylonitrile-indene copolymer; polyvinyl chloride, phenol resins, natural resin modified phenol resins, natural resin modified maleic acid resins, acrylic resins, methacrylic resins, polyvinyl acetate, silicone resins, polyester resins, polyurethane resins, polyamide resins, furan resins, epoxy resins, xylene resins, polyvinyl butyral, rosin resins, modified rosin resins, terpene resins, cumarone indene resins, and petroleum resins. Preferred polymers are styrene copolymers and polyester resins. Use of a polyester resin can make the acid value of the binder resin much higher.

The polyester resin is composed as described below.

As a dihydric alcohol component, it may include ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, a bisphenol and derivative thereof represented by the following Formula (A);

(A)

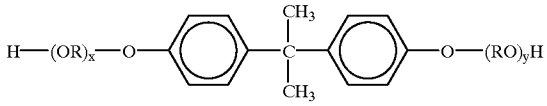

wherein R represents an ethylene group or a propylene group, x and y are each an integer of 0 or more, and an average value of x+y is 0 to 10;

and a diol represented by the following Formula (B)

(B)

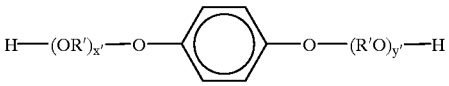

wherein R' represents —$CH_2CH_2$—,

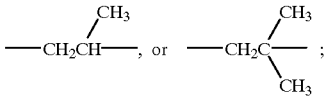

x' and y' are each an integer of 0 or more, and an average value of x'+y' is 0 to 10.

As a dibasic acid component, a dicarboxylic acid and derivatives thereof may be used, which may include, e.g., benzene dicarboxylic acids such as phthalic acid, terephthalic acid, isophthalic acid and phthalic anhydride, and anhydrides or lower alkyl esters thereof; alkyldicarboxylic acids such as succinic acid, adipic acid, sebacic acid and azelaic acid, and anhydrides or lower alkyl esters thereof; alkenylsuccinic acids or alkylsuccinic acids such as n-dodecenylsuccinic acid and n-dodecylsuccinic acid, and anhydrides or lower alkyl esters thereof; unsaturated dicarboxylic acids such as fumaric acid, maleic acid, citraconic acid and itaconic acid, and anhydrides or lower alkyl esters thereof.

A trihydric or higher alcohol component and a tribasic or higher acid component serving also as cross-linking components may also preferably be used in combination.

The trihydric or higher, polyhydric alcohol component may include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane and 1,3,5-trihydroxybenzene.

As the tribasic or higher acid component, a tribasic or higher, polycarboxylic acid or derivatives thereof may be used, which may include, e.g., trimellitic acid, pyromellitic acid,
1,2,4-benzenetricarboxylic acid,
1,2,5-benzenetricarboxylic acid,
2,5,7-naphthalenetricarboxylic acid,
1,2,4-naphthalenetricarboxylic acid,
1,2,4-butanetricarboxylic acid,
1,2,5-hexanetricarboxylic acid,
1,3-dicarboxyl-2-methyl-2-methylenecarboxypropane,
tetra(methylenecarboxyl) methane, 1,2,7,8-octanetetracarboxylic acid, Empol trimer acid, and anhydrides of these or lower alkyl esters of these. It may also include a tetracarboxylic acid represented by the following Formula (C):

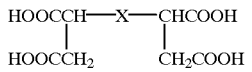

(C)

wherein X represents an alkylene group or alkenylene group having 5 to 30 carbon atoms having at least one side chain having 3 or more carbon atoms; and anhydrides thereof or lower alkyl esters thereof.

In the present invention, the alcohol component may preferably be used in an amount of from 40 to 60 mol %, and preferably from 45 to 55 mol %; and the acid component, from 60 to 40 mol %, and preferably from 55 to 45 mol %.

The trihydric or higher, polyhydric or polybasic alcohol and/or acid component(s) may preferably be used in an amount of from 1 to 60 mol % of the whole components.

The polyester resin may usually be obtained by commonly known polycondensation.

In the present invention, when the copolymer of a styrene monomer with a carboxyl group or acid anhydride group-containing monomer is used in combination with another resin, whole styrene resins including the above copolymer may preferably be contained in an amount of not less than 60% by weight, more preferably not less than 65% by weight based on the weight of the whole binder resin.

In the present invention, in order to impart release properties to the positive-chargeable toner, a wax may preferably be incorporated. The wax may preferably be a wax having a melting point of from 70 to 165° C. and a melt viscosity at 160° C. of 1,000 mPa.s or below. Such a wax may include paraffin wax, microcrystalline wax, Fischer-Tropsch wax, montan wax, straight-chain α-olefins such as ethylene, propylene, butene-1, pentene-1, hexene-1, heptene-1, octene-1, nonene-1 and decene-1, branched α-olefins having the branched moiety at the terminal, and homopolymers of olefins having these unsaturated groups at different positions, or copolymers of these.

Waxes formed into block copolymers with vinyl monomers or waxes modified by graft modification may also be used.

These waxes may also be used in combination of two or more.

The wax may preferably be added in an amount of from 0.5 to 10 parts by weight, and more preferably from 1 to 8 parts by weight, based on 100 parts by weight of the binder resin.

The wax may previously be added and mixed in the polymer components when the toner is produced. In such an instance, it is preferable to preliminarily dissolve the wax and a high-molecular-weight polymer in a solvent and thereafter mix them with a low-molecular-weight polymer solution. This can moderate the phase separation in microregions, so that the re-agglomeration of polymeric components can be restrained and also a good state of dispersion with the low-molecular-weight polymer can be obtained.

Such polymer solution thus prepared may preferably have a solid concentration of 5 to 70% by weight, taking account of dispersion efficiency, prevention of change in properties at the time of stirring and operability. The preliminary solution formed of the high-molecular-weight polymer component and the wax may preferably have a solid concentration of 5 to 60% by weight, and the low-molecular-weight polymer solution may preferably have a solid concentration of 5 to 70% by weight.

The high-molecular-weight polymer component and the wax can be dissolved or dispersed by mixing them with stirring. The stirring may preferably be carried out by a batch system or a continuous system.

The low-molecular-weight polymer solution may preferably be mixed by adding the low-molecular-weight polymer solution in an amount of from 10 to 1,000 parts by weight based on 100 parts by weight of the solid content of the preliminary solution, followed by mixing with stirring. This mixing may be carried out by either a batch system or a continuous system.

In the imidazole derivative represented by Formula (1) previously given which is used as the charge control agent of the present invention, $R_1$, $R_2$, $R_3$ and $R_4$ in the formula each represent a substituent selected from the group consisting of a hydrogen atom, an alkyl group, an aralkyl group and an aryl group. These substituents may be the same or different from one another and may each be substituted with a substituent. This substituent with which they may each be substituted may include, e.g., an amino group, an hydroxy group, an alkyl group, an alkoxy group and a halogen.

Typical examples of the substituents $R_1$, $R_2$, $R_3$ and $R_4$ includes hydrogen, a methyl group, an ethyl group, a propyl group, a butyl group, a pentyl group, a hexyl group, a heptyl group, an octyl group, a nonyl group, a decyl group, an undecyl group, a dodecyl group, a tridecyl group, a tetradecyl group, a pentadecyl group, a hexadecyl group, a heptadecyl group, an octadecyl group, a nonadecyl group, an eicosyl group, a heneicosyl group, a docosyl group, a tricosyl group, a tetracosyl group, a pentacosyl group, an i-propyl group, an i-butyl group, a t-butyl group, a cyclopentyl group, a cyclohexyl group, a benzyl group, a phenetyl group, a diphenylmethyl group, a trityl group, a cumyl group, a pheyl group, a tolyl group, a xylyl group, a mesityl group, a naphthyl group, and an anthryl group.

In the substituents $R_1$, $R_2$, $R_3$ and $R_4$, the alkyl group may be one having 1 to 25 carbon atoms, the aralkyl group may be one having 7 to 20 carbon atoms, and the aryl group may be one having 6 to 20 carbon atoms.

In the formula, X represents a connecting group selected from the group consisting of phenylene, propenylene, vinylene, alkylene and —$CR_5R_6$—. $R_5$ and $R_6$ each represent a substituent selected from the group consisting of a hydrogen atom, an alkyl group, an aralkyl group and an aryl group.

In these $R_5$ and $R_6$, the alkyl group may preferably be one having 1 to 20 carbon atoms, the aralkyl group may preferably be one having 7 to 15 carbon atoms, and the aryl group may preferably be one having 6 to 15 carbon atoms.

The imidazole derivative represented by Formula (1), used in the present invention may particularly preferably be an imidazole derivative represented by the following Formula (2) or (3).

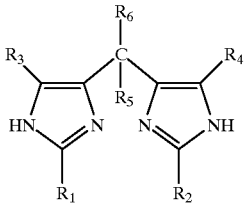

(2)

In the formula, $R_1$ and $R_2$ each represent a substituent selected from the group consisting of an alkyl group having 5 to 20 carbon atoms, an aralkyl group having 5 to 20 carbon atoms and an aryl group having 6 to 20 carbon atoms. These substituents may be the same or different from each other and may each be substituted with a substituent. This substituent with which they may each be substituted may include, e.g., an amino group, an hydroxy group, an alkyl group, an alkoxy group and a halogen.

$R_3$, $R_4$, $R_5$ and $R_6$ each represent a substituent selected from the group consisting of a hydrogen atom, an alkyl group, an aralkyl group and an aryl group. These substituents may be the same or different from one another and may each be substituted with a substituent. This substituent with which they may each be substituted may include, e.g., an amino group, an hydroxy group, an alkyl group, an alkoxy group and a halogen.

In the substituents $R_3$, $R_4$, $R_5$ and $R_6$, the alkyl group may preferably be one having 1 to 6 carbon atoms, the aralkyl group may preferably be one having 7 to 15 carbon atoms, and the aryl group may preferably be one having 6 to 15 carbon atoms.

(3)

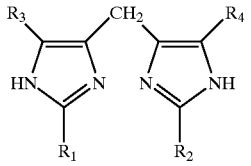

In the formula, $R_1$ and $R_2$ each represent a substituent selected from the group consisting of an alkyl group having 5 to 20 carbon atoms, an aralkyl group having 7 to 20 carbon atoms and an aryl group having 6 to 20 carbon atoms. These substituents may be the same or different from each other and may each be substituted with a substituent. This substituent with which they may each be substituted may include, e.g., an amino group, an hydroxy group, an alkyl group, an alkoxy group and a halogen.

$R_3$ and $R_4$ each represent a substituent selected from the group consisting of a hydrogen atom, an alkyl group, an aralkyl group and an aryl group. These substituents may be the same or different from each other and may each be substituted with a substituent. This substituent with which they may each be substituted may include, e.g., an amino group, an hydroxy group, an alkyl group, an alkoxy group and a halogen.

In the substituents $R_3$ and $R_4$, the alkyl group may preferably be one having 1 to 6 carbon atoms, the aralkyl group may preferably be one having 7 to 15 carbon atoms, and the aryl group may preferably be one having 6 to 15 carbon atoms.

The imidazole derivative represented by the above Formula (2) has a good dispersibility in the binder resin. The imidazole derivative represented by the above Formula (3) has also a good dispersibility and moreover a good adhesion to the binder resin, and hence can restrain sleeve contamination from occurring because of come-off of the imidazole derivative from toner particles.

If in the above Formulas (2) and (3) the alkyl group and aralkyl group represented by $R_1$ and $R_2$ each have less than 5 carbon atoms, the toner may have a low positive charging performance to make it necessary to add the imidazole derivative in a larger quantity in order for it to be effective as the positive charge control agent. If on the other hand the alkyl group, aralkyl group and aryl group represented by $R_1$ and $R_2$ each have more than 20 carbon atoms, the imidazole derivative itself may have a low melting point, and hence the imidazole derivative may have a low melt viscosity in the melt-kneading step when the toner is produced, so that it becomes difficult to uniformly disperse it in the binder resin, tending to cause deterioration of image characteristics because of incomplete dispersion. This may impose a limitation to the binder resin.

In the present invention, the imidazole derivative may be added in an amount of from 0.01 to 20.0 parts by weight, preferably from 0.1 to 10.0 parts by weight, and more preferably from 0.5 to 5.0 parts by weight, based on 100 parts by weight of the binder resin. If it is added in an amount less than 0.01 part by weight, the toner can not have a sufficient charge quantity and the addition of the imidazole derivative can not be effective. If on the other hand it is added in an amount more than 20.0 parts by weight, its addition is in excess to cause its incomplete dispersion in the toner, so that the imidazole derivative tends to be present in the form of aggregates or present in a non-uniform quantity per toner particle, undesirably.

The imidazole derivative used in the present invention may be used in combination with a conventionally known charge control agent.

The imidazole derivative used in the present invention is synthesized in the following way. Using ethanol as a solvent, aldehyde and potassium hydroxide as a solvent are added to an imidazole compound represented by the following Formula D, followed by reflux for few hours. The precipitate formed is filtered and washed with water, followed by recrystallization with methanol.

(D)

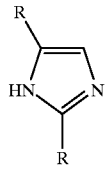

wherein R's each represent a substituent selected from the group consisting of a hydrogen atom, an alkyl group, an aryl group and an aralkyl group, and these may be the same or different from each other.

This synthesis method by no means limits the imidazole derivative used in the present invention.

Exemplary compounds of the imidazole derivative used in the present invention are shown below. These are typical examples also taking account of readiness to handle, and similarly by no means limit the toner of the present invention.

Exemplary compounds of the imidazole derivative:

(1)

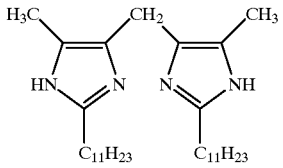

-continued
(2)
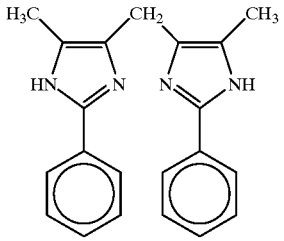
(3)
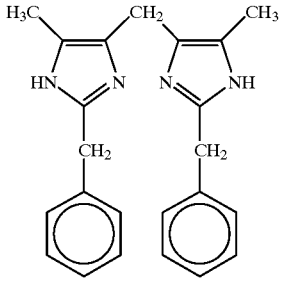
(4)
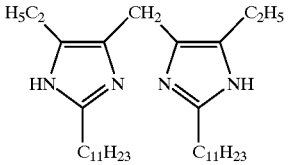
(5)
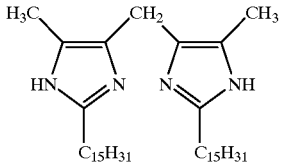
(6)
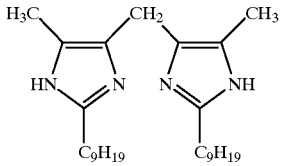
(7)
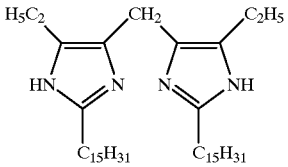
(8)
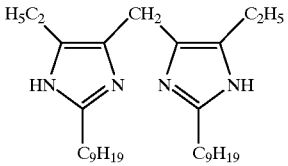
-continued
(9)
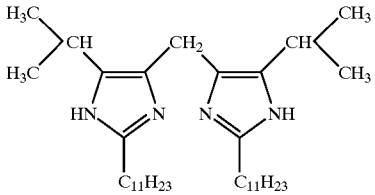
(10)
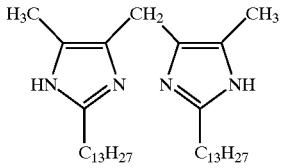
(11)
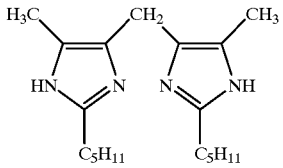
(12)
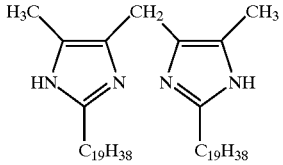
(13)
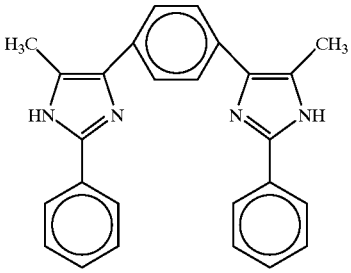
(14)
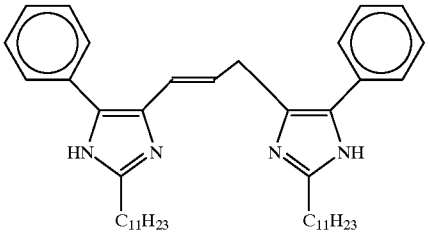

-continued
(15)
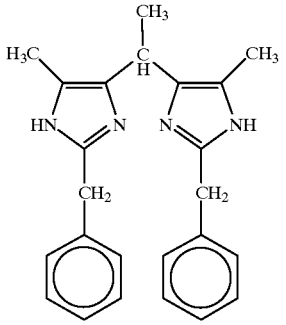
(16)
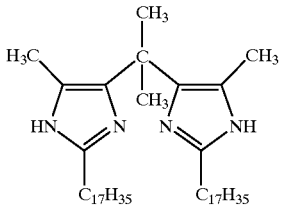
(17)
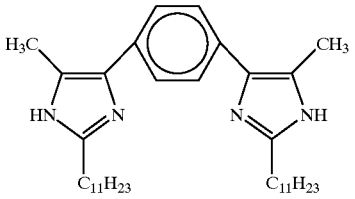
(18)
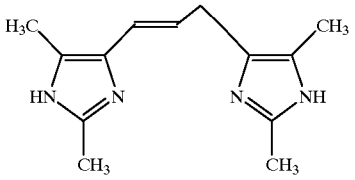
(19)
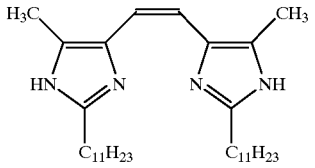
(20)
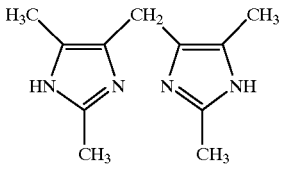
(21)
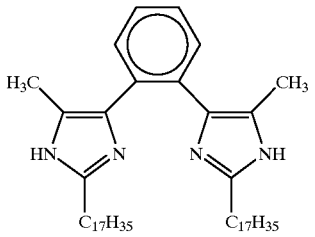
-continued
(22)
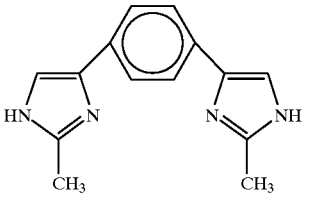
(23)
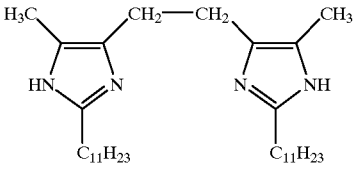
(24)
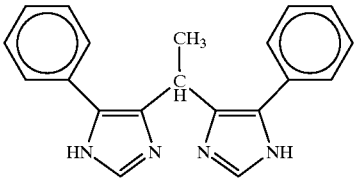
(25)
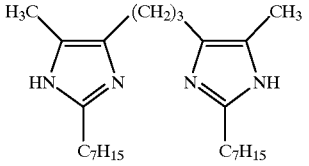
(26)
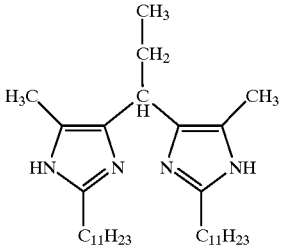
(27)
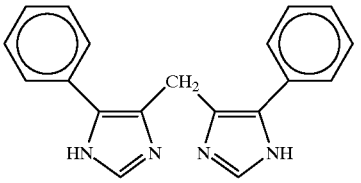
Compounds shown below are those in which some substituents of the right and left imidazoles are different or identical, and may be in the form of mixtures of any of these.

(28)

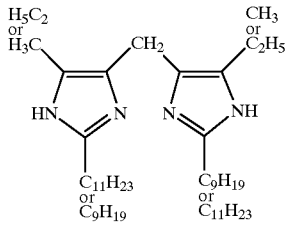

(29)

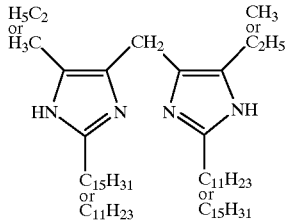

(30)

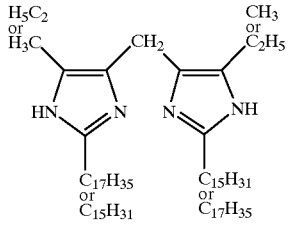

(31)

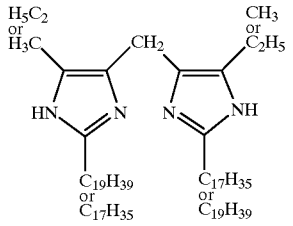

(32)

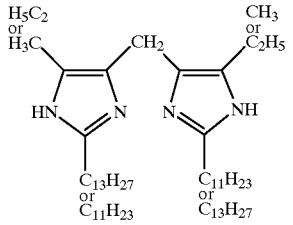

The colorant usable in the toner of the present invention may include any suitable pigments or dyes. It may include, e.g., as pigments, carbon black, Aniline Black, acetylene black, Naphthol Yellow, Hanza Yellow, Rhodamine Lake, Alizarine Lake, red iron oxide, Phthalocyanine Blue and Indanethrene Blue. Any of these may be used in a quantity necessary for maintaining optical density of fixed images, and may preferably be added in an amount of from 0.1 to 20 parts by weight, and more preferably from 0.2 to 10 parts by weight, based on 100 parts by weight of the binder resin. For the same purpose as the above, dyes may also be used, including, e.g., azo dyes, anthraquinone dyes, xanthene dyes and methine dyes. Any of these may preferably be added in an amount of from 0.1 to 20 parts by weight, and more preferably from 0.3 to 10 parts by weight, based on 100 parts by weight of the binder resin.

In the toner of the present invention, a magnetic material may be used as the colorant so that the toner can be used as a magnetic toner.

In the positive-chargeable toner of the present invention which contains the binder resin having a specific acid value and the specific imidazole derivative, the toner is especially effective when used as the magnetic toner containing a magnetic material as the colorant, because the magnetic material can be restrained from coming off toner particles.

The reason why the magnetic material can be restrained from coming off toner particles has not been made clear. It is presumed that the imidazole derivative is restrained from coming off toner particles by mutual action between the secondary amine present in the specific imidazole derivative and the carboxyl group present in the styrene copolymer, and hence the magnetic material comes to be also restrained from coming off toner particles which may otherwise come off toner particles as the imidazole derivative comes off toner particles.

The magnetic material used in the present invention may include oxides such as magnetite, maghemite and ferrite; and ferromagnetic metals such as iron, cobalt and nickel, or alloys and mixtures of any of these metals with a paramagnetic or diamagnetic metal such as aluminum, cobalt, copper, lead, magnesium, tin, zinc, antimony, beryllium, bismuth, cadmium, calcium, manganese, selenium, titanium, tungsten or vanadium; any of which may be used. Magnetic materials containing silicon element on the surface or in the inside are particularly preferred.

As a result of extensive studies made by the present inventors, it has been found that, when silicon element is incorporated in the magnetic material, the magnetic material can have a uniform particle size distribution and the dispersion of the magnetic material in the toner can be improved compared with an instance where the magnetic material contains no silicon element. It has also been found that, when the magnetic material incorporated with silicon element is incorporated in the toner, its charging uniformity can be improved and its agglomerating properties can be made lower even in the case of a toner having a weight-average particle diameter of 10 $\mu$m or smaller, bringing about an improvement in fluidity of the toner, so that initial-stage image density can be stable and image fog can be controlled to a level of almost no problem.

The silicon element incorporated in the magnetic material may preferably be in a content of from 0.05 to 10% by weight, more preferably from 0.1 to 7% by weight, and still more preferably from 0.2 to 5% by weight, based on the weight of the magnetic powder. If the silicon element is in a content less than 0.05% by weight, the addition of silicon element can not be well effective and the toner tends to have a non-uniform quantity of triboelectricity, resulting in an increase in image fogs If the silicon element is in a content more than 10% by weight, the image fog can be better prevented but the developer carrying member surface tends to be contaminated to tend to cause a decrease in image density and occurrence of ghost.

In the present invention, the quantity of silicon element in the magnetic material is measured by fluorescent X-ray analysis according to JIS K0119 "Fluorescent X-ray Analysis General Rules", using an fluorescent X-ray analyzer SYSTEM 3080 (manufactured by Rigaku Denki Kogyo K. K.)

As to the particle shape of the magnetic material used in the present invention, it may be polyhedral, e.g., hexahedral, octahedral, decahedral, dodecahedral, tetradecahedral or more, or acicular, flaky, spherical or amorphous. In particular, polyhedrons may preferably be used. In the case when the magnetic material has a polyhedral particle shape, the magnetic material can be physically prevented from coming off toner particles on account of its particle shape.

The magnetic material used in the present invention may preferably have a BET specific surface area as measured by nitrogen gas adsorption, of from 1 to 40 $m^2/g$, more preferably from 2 to 30 $m^2/g$, and still more preferably from 3 to 20 $m^2/g$. It is measured by the BET method, according to which nitrogen gas is adsorbed on the sample surface and the specific surface area is calculated by the BET multi-point method, using a specific surface area measuring device AUTOSORB-1 (manufactured by Yuasa Ionics Co., Ltd.)

If the magnetic material has a BET specific surface area smaller than 1 $m^2/g$, it tends to be released from the toner particles, and the toner tends to have excessive charges. If the magnetic material has a BET specific surface area larger than 40 $m^2/g$, excessive release of charges from the toner tends to occur, and the toner tends to have an insufficient quantity of charges.

The magnetic material may preferably have a saturation magnetization ($\sigma s$) of from 5 to 200 $Am^2/kg$, and more preferably from 10 to 150 $Am^2/kg$, under application of a magnetic field of 795.8 kA/m.

The magnetic material may also preferably have a residual magnetization ($\sigma r$) of from 1 to 100 $Am^2/kg$, and more preferably from 1 to 70 $Am^2/kg$, under application of a magnetic field of 795.8 kA/m.

If the magnetic material has a saturation magnetization smaller than 5 $Am^2/kg$, fog tends to occur in the images. If the magnetic material has a saturation magnetization greater than 200 $Am^2/kg$, it is difficult to achieve high image density.

If the magnetic material has a residual magnetization smaller than 1 $Am^2/kg$, fog tends to occur. If the magnetic material has a residual magnetization greater than 100 $Am^2/kg$, the dot reproducibility and fine-line reproducibility lower, so that high quality images are obtained with difficulty.

The magnetic material may preferably have an average particle diameter of from 0.05 to 1.0 $\mu$m, more preferably from 0.1 to 0.6 $\mu$m, and still more preferably from 0.1 to 0.4 $\mu$m.

If the magnetic material has an average particle diameter smaller than 0.05 $\mu$m, its uniform dispersion in the toner is difficult to achieve, and the toner tends to be reddish. If the magnetic material has an average particle diameter larger than 1.0 $\mu$m, it tends to become liberated from the toner, consequently tending to cause scratches of the photosensitive member.

The magnetic material incorporated in the toner in the present invention may preferably be in an amount of from 10 to 200 parts by weight, more preferably from 20 to 170 parts by weight, and still more preferably from 30 to 150 parts by weight, based on 100 parts by weight of the binder resin.

If the magnetic material in the toner is in an amount less than 10 parts by weight, the coloring performance of the toner is insufficient, so that high image density is difficult to obtain. If the magnetic material in the toner is in an amount more than 200 parts by weight, the fixing property of the toner lowers.

In the present invention, the particle shape of the magnetic material is observed using a transmission electron microscope and a scanning electron microscope.

The magnetic characteristics of the magnetic material are values measured with a vibration sample magnetic force meter VSM-3S-15 (manufactured by Toei Kogyo K. K.).

The average particle diameter of the magnetic material is determined in such a manner that 200 particles of the magnetic material with a diameter of 0.02 $\mu$m or more are selected at random from a photograph of 50,000 magnifications of the magnetic material, taken with a transmission electron microscope, and the maximum length of each particle is measured. The number average value of the maximum length is obtained and used as the average particle diameter.

In the toner of the present invention, it is preferable to add fine silica powder in order to improve charging stability, developing performance, fluidity and running performance.

As the form of addition of the fine silica powder to the toner, either of the internal addition to add it into toner particles and the external addition to mix it with toner particles can be effective. Especially in order to make the above effect more remarkable, the external addition is preferred.

The fine silica powder used in the present invention may preferably have a BET specific surface area as measured by nitrogen gas adsorption, of at least 30 $m^2/g$, and more preferably from 50 to 400 $m^2/g$, to obtain good results.

If the fine silica powder has a BET specific surface area smaller than 30 $m^2/g$, the toner is not provided with a sufficient fluidity, and it tends to have non-uniform developing performance.

The fine silica powder may preferably be contained in the toner in an amount of from 0.01 to 8 parts by weight, and more preferably from 0.1 to 5 parts by weight, based on 100 parts by weight of the toner.

If the fine silica powder is contained in the toner in an amount less than 0.01 part by weight, it is difficult to attain a sufficient fluidity and running performance of the toner. If the fine silica powder is contained in the toner in an amount more than 8 parts by weight, free powder of the fine silica powder increases in quantity, thereby tending to cause unstable charging of the toner.

If necessary, for the purpose of making hydrophobic or controlling chargeability, the fine silica powder used in the present invention may also preferably be treated with a treating agent such as silicone varnish, modified silicone varnish of various types, silicone oil, modified silicone oil of various types, a silane coupling agent, a silane compound having a functional group or other organosilicon compound, which may be used alone or in combination.

To the toner of the present invention, other external additives may optionally be added.

For example, they may include fine resin particles or fine inorganic particles that function as a charging auxiliary agent, a conductivity-providing agent, a fluidity-providing agent, an anti-caking agent, a release agent at the time of heat roller fixing, a lubricant or an abrasive.

The lubricant may include, e.g., Teflon powder, zinc stearate powder and polyvinylidene fluoride powder; in particular, polyvinylidene fluoride powder is preferred. The abrasive may include cerium oxide powder, silicon carbide powder and strontium titanate powder; in particular, strontium titanate powder is preferred. The fluidity-providing agent may include, e.g., titanium oxide powder and aluminum oxide powder; in particular, hydrophobic one is preferred. The conductivity-providing agent may include, e.g., carbon black powder, zinc oxide powder, antimony oxide powder and tin oxide powder. Reverse-polarity fine white particles and fine black particles may also be used in a small quantity as a developability improver.

The toner of the present invention can be produced by thoroughly mixing the binder resin, the colorant, the imidazole derivative, and optionally the magnetic material, the wax, metal salts or metal complexes, pigments or dyes and other additives by means of a mixing machine such as a Henschel mixer or a ball mill, thereafter melt-kneading the mixture using a heat kneading machine such as a heat roll, a kneader or an extruder, and solidifying the kneaded product by cooling, followed by pulverization and classification, and further optionally followed by mixing with any desired additives by means of a mixer such as a Henschel mixer. Thus the toner according to the present invention can be obtained.

The positive-chargeable toner of the present invention may preferably have a weight-average particle diameter of from 3 to 10 μm, and more preferably from 4 to 9 μm.

If the toner has a weight-average particle diameter smaller than 3 μm, its running stability becomes poor, and high image density is difficult to obtain, and further fog tends to occur. If the toner has a weight-average particle diameter larger than 10 μm, it is difficult to obtain highly precise images, and the consumption of the toner increases.

The weight-average particle diameter of the toner is measured using Coulter counter Model TA-II (manufactured by Coulter Electronics, Inc.). Coulter Multisizer (manufactured by Coulter Electronics, Inc.) may also be used. As an electrolytic solution, an aqueous 1% NaCl solution is prepared using first-grade sodium chloride. For example, ISOTON R-II (trade name, manufactured by Coulter Scientific Japan Co.) may be used. Measurement is carried out by adding as a dispersant 0.1 to 5 ml of a surface active agent, preferably an alkylbenzene sulfonate, to 100 to 150 ml of the above aqueous electrolytic solution, and further adding 2 to 20 mg of a sample to be measured. The electrolytic solution in which the sample has been suspended is subjected to dispersion for about 1 minute to about 3 minutes in an ultrasonic dispersion machine. The volume distribution and number distribution are calculated by measuring the volume and number of toner particles with a diameter of 2.00 μm or more by means of the above measuring device, using an aperture of 100 μm as its aperture. Then the value according to the present invention, the weight-based, weight average particle diameter (D4: the middle value of each channel is used as the representative value for each channel) determined from the volume distribution is determined.

As channels, 13 channels are used, which are of 2.00 to less than 2.52 μm, 2.52 to less than 3.17 μm, 3.17 to less than 4.00 μm, 4.00 to less than 5.04 μm, 5.04 to less than 6.35 μm, 6.35 to less than 8.00 μm, 8.00 to less than 10.08 μm, 10.08 to less than 12.70 μm, 12.70 to less than 16.00 μm, 16.00 to less than 20.20 μm, 20.20 to less than 25.40 μm, 25.40 to less than 32.00 μm, and 32.00 to less than 40.30 μm.

The constitution of a developing sleeve which is the developer carrying member used in the image forming method of the present invention will be described below with reference to FIG. 1 as an example.

The developing sleeve which is the developer carrying member used in the present invention has at least a surface formed of a material containing a resin. More specifically, the developing sleeve is a cylindrical sleeve composed of a material containing a resin, or has a cylindrical substrate 6 and a coat layer 1 formed on the cylindrical substrate and containing a resin. The coat layer 1 contains a binder resin 4 and in addition thereto further optionally contain a conductive material 2, a filler 3 and a solid lubricant 5 and is so formed as to cover the cylindrical substrate 6. When the conductive material 2 is contained, the coat layer 1 has a conductivity and hence can prevent the toner from being excessively charged. When the filler 3 is contained, the coat layer can be prevented from being worn by the toner and also the charge-providing properties attributable to the filler 3 enable preferable control of the charging of toner. When the solid lubricant 5 is contained, the releasability of the toner from the developing sleeve can be improved, so that the toner can be prevented from melt-adhering onto the developing sleeve.

The cylindrical substrate on which the coat layer containing a resin is formed may be formed of a material including metals, alloys, metallic compounds, ceramics and resins.

In the present invention, when the conductive material is contained in the coat layer, the coat layer may preferably have a volume resistivity of $10^6$ Ω.cm or below, and more preferably $10^3$ Ω.cm or below. If the coat layer has a volume resistivity higher than $10^6$ Ω.cm, the toner tends to cause charge-up, which may cause occurrence of blotches or deterioration of developing performance.

The coat layer may preferably have a surface roughness in the range of from 0.2 to 3.5 as JIS centerline average roughness (Ra). If its Ra is smaller than 0.2 μm, the toner may have so excessively high a charge quantity in the vicinity of the developing sleeve that the toner is attracted onto the developing sleeve by the action of mirror force and any new toner can no longer receive charges from the developing sleeve, resulting in an insufficient developing performance. If the Ra is larger than 3.5 μm, the toner may be coated on the developing sleeve in a too large quantity to obtain a sufficient charge quantity, also resulting in non-uniform charging to cause a decrease in image density and an uneven density.

Materials that constitute the coat layer 1 will be described below.

The conductive material 2 shown in FIG. 1 may include, e.g., powders of metals such as aluminum, copper, nickel and silver; metal oxides such as antimony oxide, indium oxide and tin oxide; and carbon allotropes such as carbon fiber, carbon black and graphite. Of these, carbon black is preferably used because it has an especially good electrical conductivity, can impart a conductivity by adding it to a polymeric material and can obtain a desired conductivity to a certain extent by controlling the quantity for its addition.

The carbon black used in the present invention may preferably have a number-average particle diameter of 1 μm or smaller, and preferably from 0.01 μm to 0.8 μm. Carbon black having a number-average particle diameter larger than 1 μm is not preferable because it may make it difficult to control the volume resistivity of the coat layer.

The conductive material may preferably be used in an amount of from 0.1 to 300 parts by weight, and more preferably from 1 to 100 parts by weight, based on 100 parts by weight of the resin.

As the filler 3, a conventionally known negative charge control agent or positive charge control agent for toner may be added. As other materials, they may include, e.g., inorganic compounds such as alumina, asbestos, glass fiber, calcium carbonate, magnesium carbonate, barium carbonate, barium sulfate, silica and calcium silicate; phenol resins, epoxy resins, melamine resins, silicone resins, PMMA, terpolymers of methacrylate (e.g., polystyrene/n-butyl methacrylate/silane terpolymer), styrene-butadiene copolymers and polycaprolactone; nitrogen-containing compounds such as polycarprolactam, polyvinyl pyridine and polyamide; highly halogenated polymers such as polyvinylidene fluoride, polyvinyl chloride, polytetrafluoroethylene, polytetrachlorofluoroethylene, perfluoroalkoxylated ethylene, polytetrafluoroalkoxyethylene, fluorinated ethylene-propylene-polytetrafluoroethylene copolymer and triflurochloroethylene-vinyl chloride copolymer; polycarbonates; and polyesters. Of these, silica and alumina may preferably be used because they by itself have a hardness and a charge controllability to toner.

The filler may preferably be used in an amount of from 0.1 to 500 parts by weight, and more preferably from 1 to 200 parts by weight, based on 100 parts by weight of the resin.

The solid lubricant 5 may include, e.g., molybdenum disulfide, boron nitride, graphite, graphite fluoride, silver-niobium selenide, calcium chloride-graphite and talc. Of these, graphite may preferably be used because it has a lubricity and also a conductivity and has the function to lessen the toner having an excessively high charge and provide a charge quantity preferable for development.

The solid lubricant may preferably be used in an amount of from 0.1 to 300 parts by weight, and more preferably from 1 to 150 parts by weight, based on 100 parts by weight of the resin.

The resin 4 in which the conductive material 2, filler 3 and solid lubricant 5 are to be dispersed may include phenol resins, epoxy resins, polyamide resins, polyester resins, polycarbonate resins, polyolefin resins, silicone resins, fluorine resins, styrene resins and acrylic resins, any of which may be used. In particular, thermosetting or photosetting resins are preferred.

In order to make preferably lay bare to the surface the conductive material, filler and or solid lubricant in the coat layer formed on the surface of the developing sleeve in the present invention, or in order to smooth the coat layer surface to form a uniformly rough surface, the surface of the coat layer may be subjected to smoothing by polishing as described later, whereby a more preferable performance can be imparted. This is effective especially against the phenomenon of vertical lines occurring on solid black or halftone images and for the rise of image density at the initial stage, and is greatly effective especially in an environment of high temperature and high humidity.

Figure 2A:
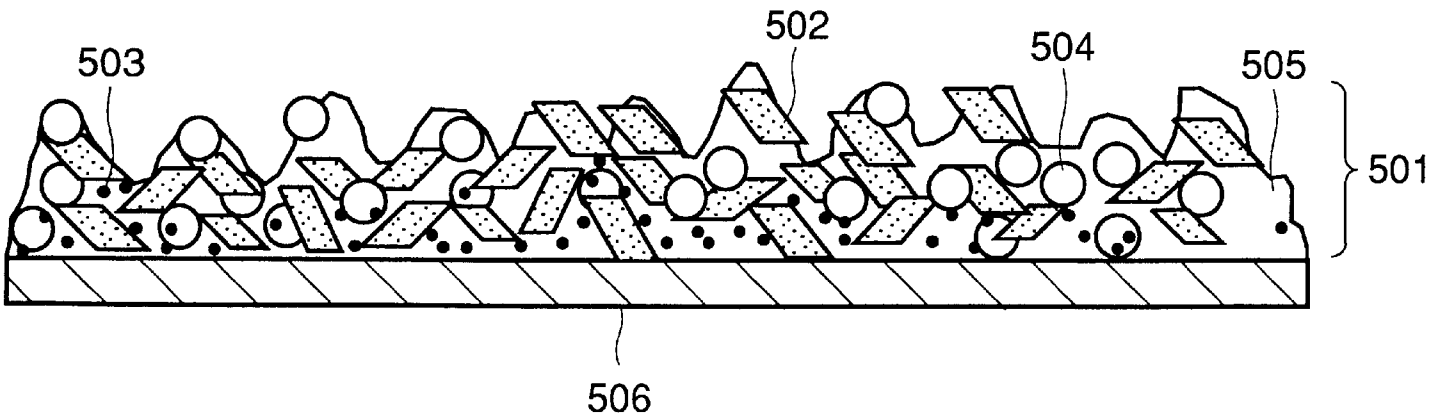
FIGS. 2A and 2B are partial schematic cross-sectional views of a developer carrying member according to the present invention.
Figure 2B:
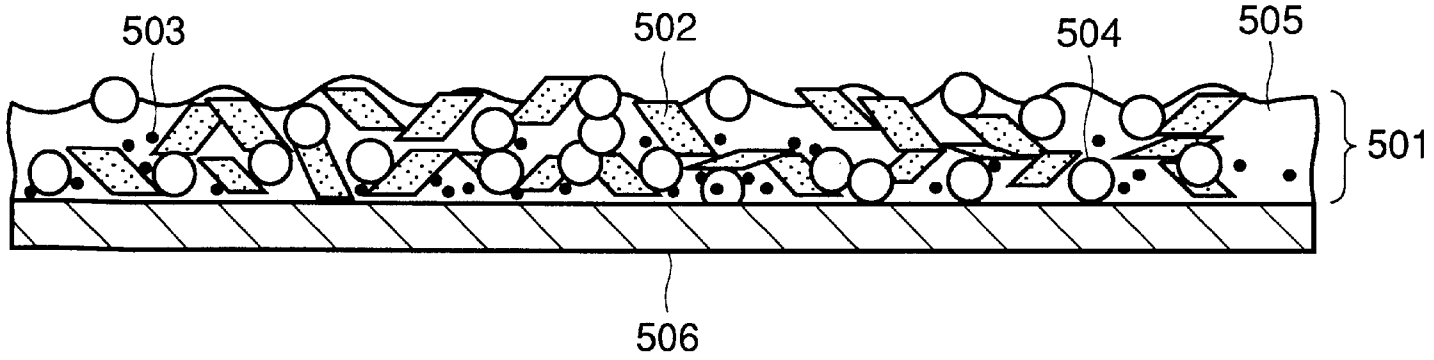

An example of how to make the smoothing of developing sleeve surface in the present invention will be described with reference to FIGS. 2A and 2B. In FIG. 2A, a coat layer 501 contains a solid lubricant 502, a conductive material 503, a filler 504 and a coat resin 505, and covers the surface of a cylindrical substrate 506. This layer is polished with felt or with a belt-like polishing material to which abrasive grains have adhered, whereby the rough surface of a developing sleeve can be uniformly finished as shown in FIG. 2B. Hence, the toner can be coated on the developing sleeve in a uniform quantity, so that only the toner triboelectrically charged by the friction with the developing sleeve is transported to the developing zone. Thus, the smoothing is considered effective as stated above.

Even after the smoothing as described above, it is preferable for the surface of the coat layer to retain a roughness of from 0.2 to 3.5 $\mu$m, and more preferably from 0.3 to 2.5 $\mu$m, as Ra according to JIS B0601. The reason therefor is the same as the above.

A developing assembly in which the developing sleeve which is the developer carrying member of the present invention is incorporated will be described below.

Figure 3:
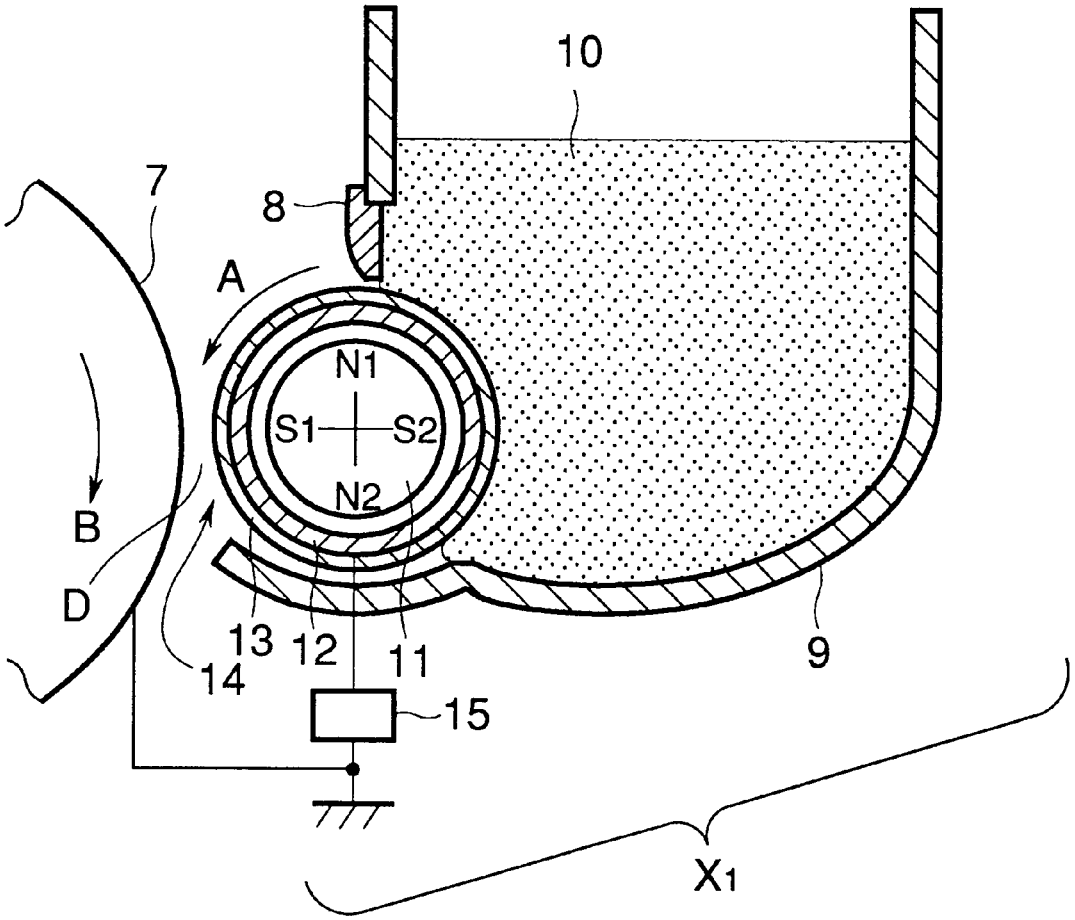
FIG. 3 is a schematic view showing an example of a developer assembly of a magnetic developer supply type to which the developer carrying member according to the present invention is set in (a magnetic blade is used as a layer thickness regulation member).

As shown in FIG. 3, in a developing assembly X1, an electrostatic latent image bearing member, e.g., an electrophotographic photosensitive drum 7, holding thereon an electrostatic latent image formed by a known process, is rotated in the direction of an arrow B. A developing sleeve 14 as the developer carrying member carries a magnetic toner 10 as one component type developer, fed from a hopper 9 serving as a developer container, and is rotated in the direction of an arrow A. Thus, the magnetic toner 10 is transported to the developing zone D where the developing sleeve 14 and the photosensitive drum 7 face each other. Inside the developing sleeve 14, a magnet 11 is provided so that the magnetic toner 10 is magnetically attracted and held onto the developing sleeve 14. The magnetic toner 10 gains triboelectric charges enabling development of the electrostatic latent image on the photosensitive drum 7 as a result of the friction between the toner particles and the developing sleeve 14.

In order to regulate the layer thickness of the magnetic toner 10 transported to the developing zone D, a regulation blade 8 made of a ferromagnetic metal, serving as a developer layer thickness regulation member, vertically extends downwards from the hopper 9 in such a manner that its lower end faces the developing sleeve 14, leaving a gap of about 200 to 300 $\mu$m wide. The magnetic line of force exerted from a magnetic pole N1 of the magnet 11 is converged to the regulation blade 8 to thereby form on the developing sleeve 14 a thin layer (developer layer) of the magnetic toner 10. A non magnetic blade may be used as the regulation blade 8.

The thickness of the thin layer of the magnetic toner 10, thus formed on the developing sleeve 14, may preferably be smaller than the minimum gap between the developing sleeve 14 and the photosensitive drum 7 in the developing zone D. The present invention is especially effective in the developing assembly of the type the electrostatic latent image is developed through such a developer thin layer, i.e., a non-contact type developing assembly. The present invention may also be applied in a developing assembly of the type the thickness of the developer layer is larger than the minimum gap between the developing sleeve 14 and the photosensitive drum 7 in the developing zone D, i.e., a contact type developing assembly.

To avoid complicacy of description, the non-contact developing assembly is taken as an example in the following description.

In order to cause to fly the one component type developer magnetic toner 10 carried on the developing sleeve 14, a development bias voltage is applied to the developing sleeve through a power source 15. When a DC voltage is used as the development bias voltage, a voltage having a value intermediate between the potential at electrostatic latent image areas (the region rendered visible upon attraction of the magnetic toner 10) and the potential at back ground areas may preferably be applied to the developing sleeve 14. Meanwhile, in order to enhance the density of developed images or improve the gradation thereof, an alternating bias voltage may be applied to the developing sleeve 14 to form in the developing zone D a vibrating electric field whose direction alternately reverses. In such a case, an alternating bias voltage formed by superimposing the DC voltage component having a value intermediate between the potential at image areas to be developed and the potential at back ground areas may preferably be applied to the developing sleeve 14.

In the case of what is called regular development, where a toner is attracted to high-potential areas of an electrostatic latent image having high-potential areas and low-potential areas, a toner chargeable to a polarity reverse to the polarity of the electrostatic latent image is used. On the other hand, in the case of what is called reverse development, where a toner is attracted to low-potential areas of an electrostatic latent image having high-potential areas and low-potential areas, a toner chargeable to the same polarity as the polarity of the electrostatic latent image is used. What is meant by the high-potential areas or the low-potential areas is expressed by the absolute value. In either case, the magnetic toner 10 is charged upon its friction with the developing sleeve 14 to have the polarity for developing the electrostatic latent image.

Figure 4:
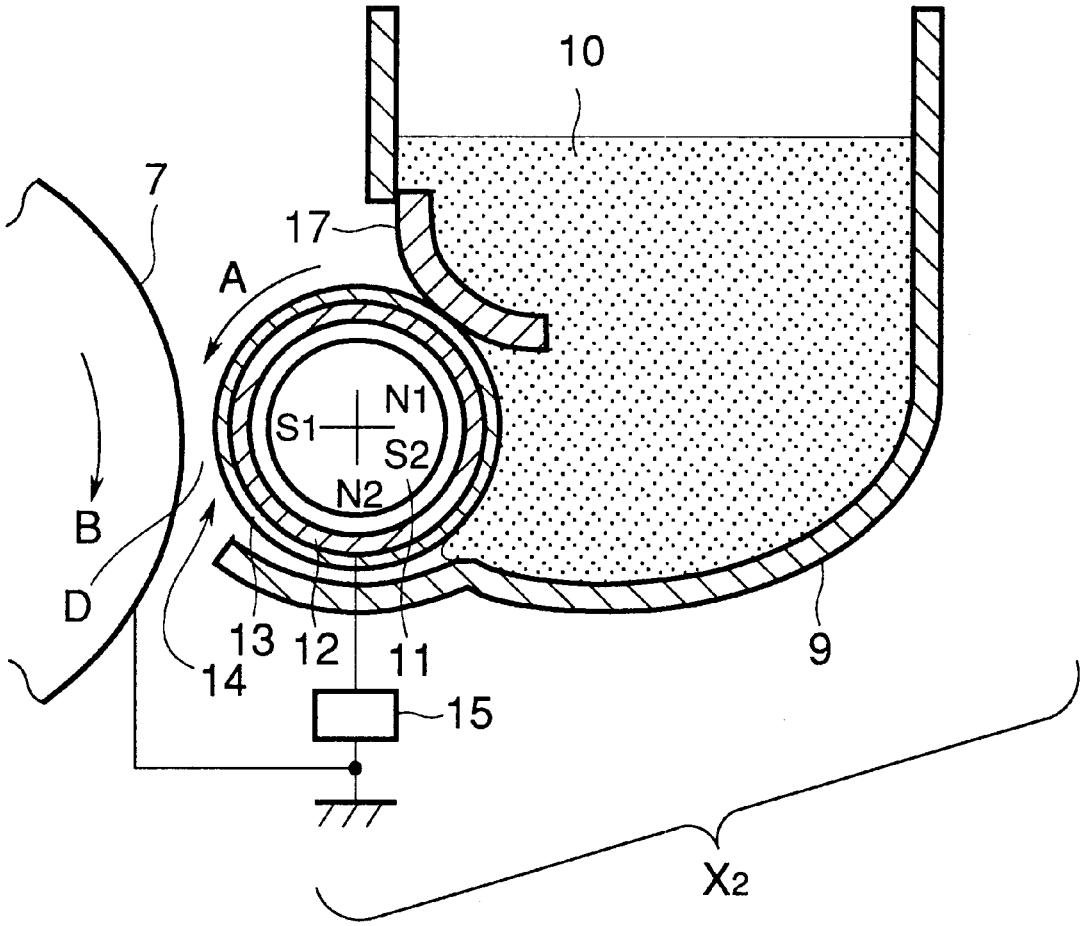
FIG. 4 is a schematic view showing another example of a developer assembly of a magnetic developer supply type to which the developer carrying member according to the present invention is set in (an elastic blade is used as a layer thickness regulation member).

FIG. 4 illustrates the construction of a developing assembly according to another embodiment.

A developing assembly X2 shown in FIG. 4 has the following features: An elastic plate comprised of a material having a rubber elasticity, such as urethane rubber or silicone rubber, or a material having a metal elasticity, such as bronze or stainless steel, is used as the developer layer thickness regulation member to regulate the layer thickness of the magnetic toner 10 on the developing sleeve 14, and this elastic plate 17 is brought into pressure touch with the developing sleeve 14. In such a developing assembly, a much thinner toner layer can be formed on the developing sleeve 14. Other constitution of the developing assembly X2 shown in FIG. 4 is substantially the same as that of the developing assembly X1 shown in FIG. 3. Thus, in FIG. 4, the like reference numerals as those given in FIG. 3 denote the like members.

In the developing assembly X2 as shown in FIG. 4, in which the toner layer is formed on the developing sleeve 14 as described above, the toner is rubbed against the developing sleeve 17 by the aid of the elastic plate 17, and hence the toner can have a large quantity of triboelectricity to bring about an improvement in image density. In a non-magnetic one-component developer, a developing assembly making use of such an elastic plate is used.

An example of the image forming method of the present invention will be described below with reference to FIG. 5, which schematically illustrates the constitution of an image forming apparatus having a contact charging/contact transport system.

Figure 5:
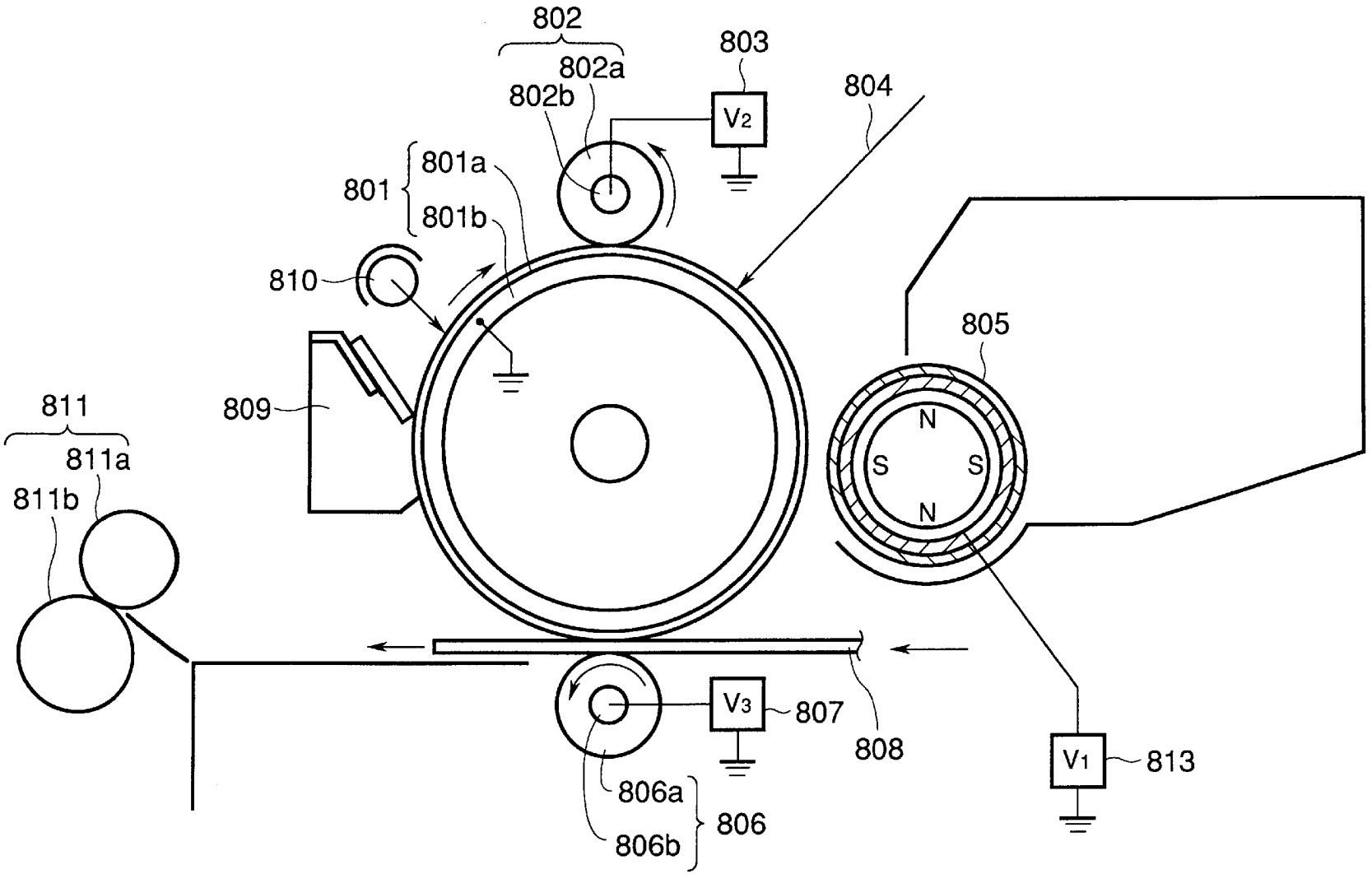
FIG. 5 is a schematic view for illustrating the image forming method of the present invention.

In FIG. 5, reference numeral 801 denotes a rotating drum type photosensitive member, which is clockwise rotated as viewed in the drawing, at a stated peripheral speed (process speed). Reference numeral 802 denotes a charging roller as a primary charging means, which is brought into pressure contact with the surface of the photosensitive drum 801 at a pressure, and is rotated followingly as the photosensitive drum 801 is rotated. Reference numeral 803 denotes a charging bias power source V2 for applying a voltage to the charging roller 802. Application of a bias to the charging roller 802 causes the surface of the photosensitive drum 1 to be charged to given polarity and potential. Imagewise exposure 804 subsequently carried out gives formation of electrostatic latent images, which are developed by a developing means 805 and successively converted into visible images as toner images.

To the developing sleeve constituting the developing means 805, a bias V1 is applied through a bias applying means 813. The toner image formed on the latent image bearing member by development is electrostatically transferred to a transfer medium 808 by means of a contact transfer means transfer roller 806 to which a transfer bias V3 is kept applied. The toner image transferred onto the transfer medium is heat and pressure fixed through a heat-and-pressure means 811. The surface of the photosensitive member 801 from which the toner image has been transferred is cleaned by removing any adhering contaminants such as transfer residual toner by means of a cleaning unit 809 provided with an elastic cleaning blade brought into pressure contact with the photosensitive member 801 in its counter direction, and is further destaticized by means of a charge-eliminating exposure unit 810 so that images can be repeatedly formed thereon.

As the primary charging means, the charging roller 802 is used as the contact charging means in the above description. It may also be a contact charging means such as a charging blade or a charging brush. It may still also be a non-contact corona charging means. However, the contact charging means is preferred in view of less ozone caused by charging.

As the transfer means, the transfer roller 806 is used in the above description. It may also be a non-contact corona transfer means. However, the contact transfer means is preferred also in view of less ozone caused by charging.

The apparatus unit of the present invention will be described below with reference to FIG. 3.

The apparatus unit of the present invention is mounted detachably to the main body of the image forming apparatus (e.g., a copying machine, a laser beam printer or a facsimile system).

In the embodiment shown in FIG. 3, the apparatus unit is the developing assembly X1, and the developing assembly X1 is mounted detachably to the main body of the image forming apparatus. Thus, the apparatus unit has the developer 10, the developer container 9, the developer carrying member 14 and the developer layer thickness regulation member 8. However, the apparatus unit of the present invention may have at least the developer 10, the developer container 9 and the developer carrying member 14.

Figure 6:
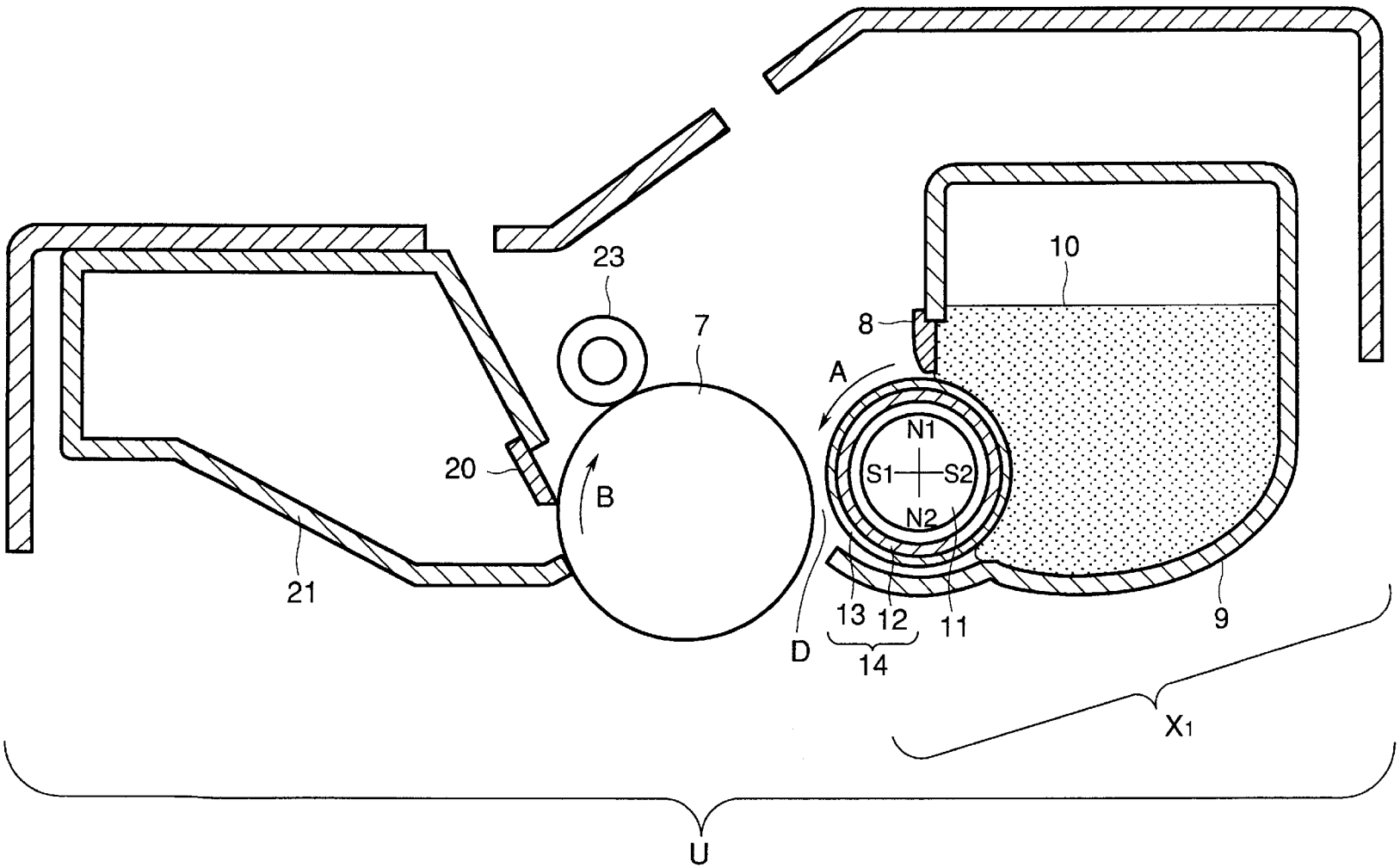
FIG. 6 schematically illustrates the apparatus unit of the present invention.

As also shown in FIG. 6, an apparatus unit U may have, in addition to the developing assembly X1, an electrostatic latent image bearing member 7, a cleaner 21 having a cleaning member 20 and a charging member 23 as one unit.

In the apparatus unit shown in FIG. 3 and the apparatus unit shown in FIG. 6, the apparatus unit is changed for new one when the developer 10 in the developing assembly X1 is used up.

Figure 7:
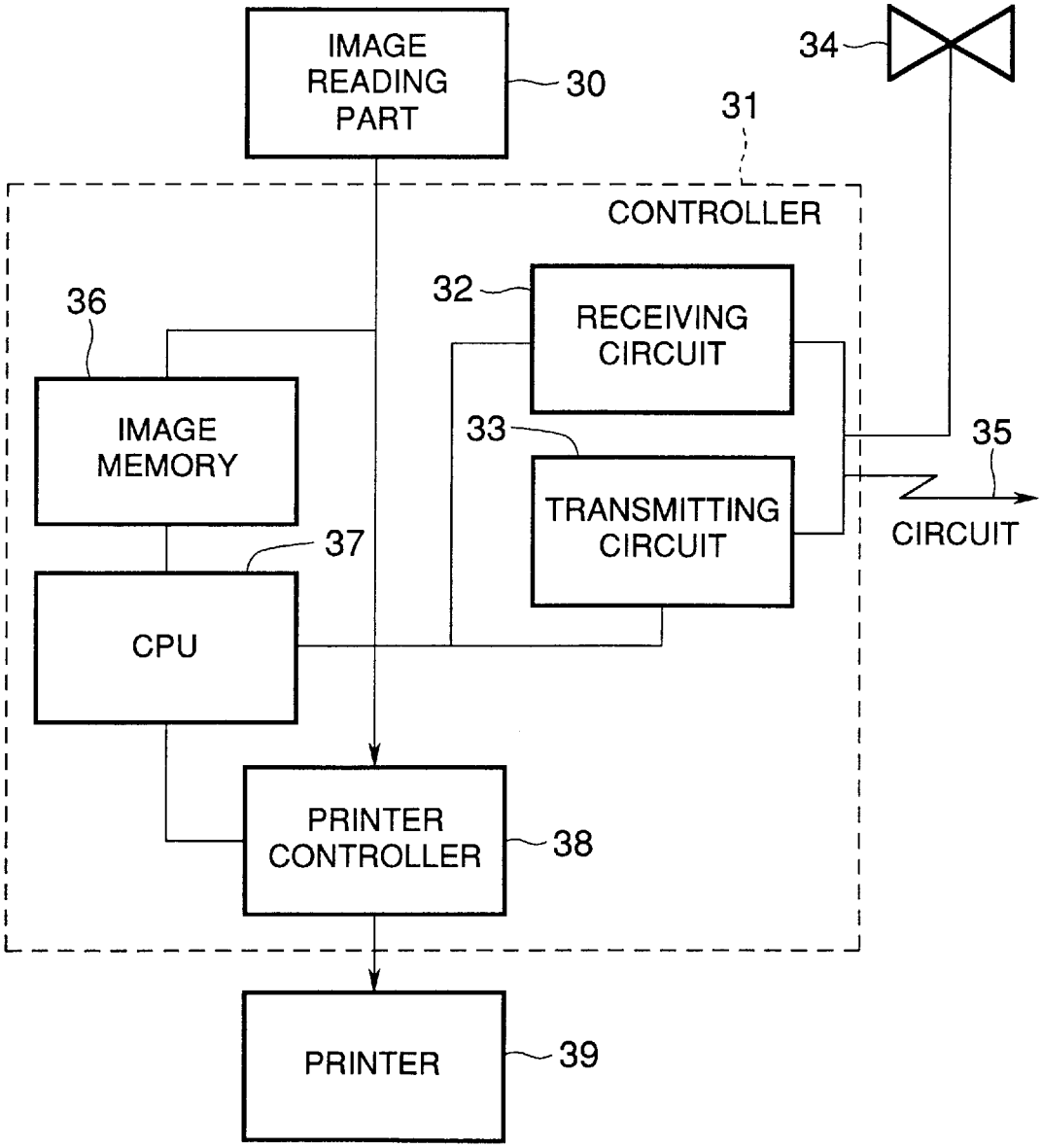
FIG. 7 is a block diagram in an instance where the image forming method of the present invention is applied to a printer of a facsimile system.

When the image forming apparatus is used as a printer of a facsimile machine, optical image exposure L serves as exposing light used for the printing of received data. FIG. 7 illustrates an example thereof in the form of a block diagram.

A controller 31 controls an image reading part 30 and a printer 39. The whole of the controller 31 is controlled by CPU 37. Image data read and outputted from the image reading part are sent to the other facsimile station through a transmitting circuit 33. Data received from the other station is sent to a printer 39 through a receiving circuit 32. Given image data are stored in an image memory 36. A printer controller 38 controls the printer 39. The numeral 34 denotes a telephone.

An image received from a circuit 35 (image information from a remote terminal connected through the circuit) is demodulated in the receiving circuit 32, and then successively stored in an image memory 36 after the image information is decoded by the CPU 37. Then, when images for at least one page have been stored in the memory 36, the image recording for that page is carried out. The CPU 37 reads out the image information for one page from the memory 36 and sends the coded image information for one page to the printer controller 38. The printer controller 38, having received the image information for one page from the CPU 37, controls the printer 39 so that the image information for one page is recorded.

The CPU 37 receives image information for next page in the course of the recording by the printer 39.

Images are received and recorded in this way.

According to the present invention, in the positive-chargeable toner containing the binder resin containing a styrene copolymer and having a specific acid value, the specific imidazole derivative is used as a charge control agent. This can achieve a dramatic improvement in anti-offset properties without damaging the charging performance and developing performance of the positive-chargeable toner. In addition, when the member comprising a metal substrate and formed thereon a coat layer containing a resin is used as the developer carrying member, the charge-providing performance can be greatly improved and highly minute images can be provided over a long period of time without causing image density decrease and fog.

EXAMPLES

The present invention will be described below in greater detail by giving Examples. The present invention is by no means limited to these.

Binder Resin Synthesis Examples

| Resin Synthesis Example 1 | (by weight) |
|---|---|
| Styrene | 79.2 parts |
| n-Butyl acrylate | 20.0 parts |
| Monobutyl maleate | 0.8 part |
| 2,2'-Azobis(2,4-diemthylvaleronitrile) | 0.2 part |

The above materials were dropwise added in 200 parts by weight of heated xylene over a period of 4 hours. Then, polymerization was completed under reflux of xylene and the solvent was removed by distillation under reduced pressure. The resin thus obtained was designated as resin a.

| | |
|---|---|
| Resin a | 30.0 parts |
| Styrene | 56.0 parts |
| n-Butyl acrylate | 12.2 parts |
| Monobutyl maleate | 1.4 parts |
| Divinylbenzene | 0.4 part |
| Di-tert-butyl peroxide | 1.0 part |

The above materials were dropwise added in 200 parts by weight of heated xylene over a period of 4 hours. Then, polymerization was completed under reflux of xylene and the solvent was removed by distillation under reduced pressure. The resin thus obtained was designated as resin A. This resin A had an acid value of 5.2.

| Resin Synthesis Example 2 | (by weight) |
|---|---|
| Styrene | 79.0 parts |
| n-Butyl acrylate | 21.0 parts |
| 2,2'-Bis(4,4-di-tert-butylperoxycyclohexyl)propane | 0.3 part |

The above materials were dropwise added in 200 parts by weight of heated xylene over a period of 4 hours. Then, polymerization was completed under reflux of xylene to obtain a xylene solution having resin b-1.

| | |
|---|---|
| Styrene | 82.0 parts |
| n-Butyl acrylate | 17.0 parts |
| Monobutyl maleate | 1.0 part |
| Di-tert-butyl peroxide | 1.0 part |

The above materials were dropwise added in 200 parts by weight of heated xylene over a period of 4 hours. Then, polymerization was completed under reflux of xylene to obtain a xylene solution having resin b-2. The two kinds of xylene solutions were so mixed that the resin components resin b-1 and resin b-2 were in a weight ratio of b-1:b-2= 25:75, and thereafter the solvent was removed by distillation under reduced pressure. The resin thus obtained was designated as resin B. This resin B had an acid value of 2.3.

| Resin Synthesis Example 3 | (by weight) |
|---|---|
| Styrene | 77.0 parts |
| n-Butyl acrylate | 20.0 parts |
| Monobutyl maleate | 3.0 parts |
| 2,2-Bis-(4,4-di-tert-butylperoxycyclohexyl) propane | 0.3 part |

The above materials were dropwise added in 200 parts by weight of heated xylene over a period of 4 hours. Then, polymerization was completed under reflux of xylene to obtain a xylene solution having resin c-1.

| | |
|---|---|
| Styrene | 78.0 parts |
| n-Butyl acrylate | 18.0 parts |
| Methacrylic acid | 4.0 parts |
| Di-tert-butyl peroxide | 1.0 part |

The above materials were dropwise added in 200 parts by weight of heated xylene over a period of 4 hours. Then, polymerization was completed under reflux of xylene to obtain a xylene solution having resin c-2. The two kinds of xylene solutions were so mixed that the resin components resin c-1 and resin c-2 were in a weight ratio of c-1:c-2=4:6, and thereafter the solvent was removed by distillation under reduced pressure. The resin thus obtained was designated as resin C. This resin C had an acid value of 18.8.

| Resin Synthesis Example 4 | (by weight) |
|---|---|
| Styrene | 74.0 parts |
| Butyl acrylate | 22.0 parts |
| Acrylic acid | 3.5 parts |
| Divinylbenzene | 0.5 part |
| Di-tert-butyl peroxide | 0.8 part |

The above materials were dropwise added in 200 parts by weight of heated xylene over a period of 4 hours. Then, polymerization was completed under reflux of xylene and the solvent was removed by distillation under reduced pressure. The resin thus obtained was designated as resin D. This resin D had an acid value of 27.0.

| Resin Synthesis Example 5 | (by weight) |
|---|---|
| Styrene | 73.0 parts |
| Butyl acrylate | 22.2 parts |
| Acrylic acid | 4.5 parts |
| Divinylbenzene | 0.5 part |
| Di-tert-butyl peroxide | 0.8 part |

The above materials were dropwise added in 200 parts by weight of heated xylene over a period of 4 hours. Then, polymerization was completed under reflux of xylene and the solvent was removed by distillation under reduced pressure. The resin thus obtained was designated as resin E. This resin E had an acid value of 34.8.

| Resin Synthesis Comparative Example 1 | (by weight) |
|---|---|
| Styrene | 80.0 parts |
| n-Butyl acrylate | 20.0 parts |
| 2,2'-Bis(4,4-di-tert-butylperoxycyclohexyl)propane | 0.3 part |

The above materials were dropwise added in 200 parts by weight of heated xylene over a period of 4 hours. Then, polymerization was completed under reflux of xylene to obtain a xylene solution having resin f-1.

| | |
|---|---|
| Styrene | 83.0 parts |
| n-Butyl acrylate | 17.0 parts |
| Di-tert-butyl peroxide | 1.0 part |

The above materials were dropwise added in 200 parts by weight of heated xylene over a period of 4 hours. Then, polymerization was completed under reflux of xylene to obtain a xylene solution having resin f-2. The two kinds of xylene solutions were so mixed that the resin components resin f-1 and resin f-2 were in a weight ratio of f-1:f-2=3:7, and thereafter the solvent was removed by distillation under reduced pressure. The resin thus obtained was designated as resin F. This resin F had an acid value of 0.1.

| Resin Synthesis Comparative Example 2 | (by weight) |
|---|---|
| Styrene | 69.0 parts |
| Butyl acrylate | 22.0 parts |
| Methacrylic acid | 8.5 parts |
| Divinylbenzene | 0.5 part |
| Di-tert-butyl peroxide | 0.8 part |

The above materials were dropwise added in 200 parts by weight of heated xylene over a period of 4 hours. Then, polymerization was completed under reflux of xylene and the solvent was removed by distillation under reduced pressure. The resin thus obtained was designated as resin G. This resin G had an acid value of 55.2.

| Resin Synthesis Comparative Example 3 | (by weight) |
|---|---|
| Propylene oxide adduct of Bisphenol A (average molecular weight: 360) | 110 parts |
| Fumaric acid | 25 parts |
| Trimellitic acid | 4 parts |

The above materials were subjected to dehydration polycondensation in a nitrogen stream at 200° C. under ordinary pressure. Then, the reaction was further allowed to proceed at 220° C. under reduced pressure. The polyester resin H thus obtained had an acid value of 1.0.

Resin Synthesis

Comparative Example 4

The synthesis of Resin Synthesis Comparative Example 3 was repeated except that the reaction was allowed to proceed while monitoring acid value and the reaction was completed at the time the acid value came to be at least 8.

The polyester resin I thus obtained had an acid value of 5.5.

| Developing Sleeve Production Example 1 | (by weight) |
|---|---|
| Phenol resin intermediate | 125 parts |
| Carbon black | 5 parts |
| Crystalline graphite | 45 parts |
| Methanol | 41 parts |
| Isopropyl alcohol | 284 parts |

A methanol solution of the phenol resin intermediate was diluted with isopropyl alcohol (IPA), followed by addition of the carbon black and crystalline graphite, which were then dispersed by means of a sand mill making use of glass beads, to obtain a coating material. Next, this coating material was coated on a sleeve substrate to form a coat layer.

As the sleeve substrate used, the surface of a cylindrical stainless steel pipe of 20 mm in external diameter and 0.8 mm in wall thickness was put to polishing to make the cylindrical pipe have a rotational deflection of 10 μm or less and a surface roughness of 4 μm or less as expressed by Ra. This sleeve substrate was set upright and rotated at a constant speed and also its upper and lower ends were masked, where the above coating material was coated while descending a spray gun at a constant speed. The masking at each end of the sleeve was set in a width of 3 mm. The sleeve thus coated was dried in a drying furnace at 160° C. for 20 minutes to cause the coating to harden. Thereafter, the surface of the sleeve thus resin-coated was rubbed with a belt-like felt under a pressing load of 4 kgf to polish the surface. Thus, a sleeve with a coat layer having a uniform layer thickness was obtained.

This coated layer had a layer thickness of 10 μm, a surface roughness Ra of 0.86 μm on the 6-point average and a volume resistivity of 4 Ω·cm. Its pencil hardness was also measured to find that it was 2 H. To this sleeve, a magnet was inserted and flanges were attached to both ends to obtain developing sleeve 1.

| Developing Sleeve Production Example 2 | (by weight) |
|---|---|
| Phenol resin intermediate | 125 parts |
| Carbon black | 5 parts |
| Crystalline graphite | 45 parts |
| Surface-treated fine silica powder (a dry-process fine silica powder having a BET specific surface area of about $1.3 \times 10^5$ $m^2/kg$, surface-treated with methyltrimethoxysilane) | 25 parts |
| Methanol | 58 parts |
| Isopropyl alcohol | 408 parts |

The above materials were dispersed using a sand mill in the following way: A methanol solution of the phenol resin intermediate was diluted with a portion of the isopropyl alcohol (IPA), followed by addition of the carbon black and crystalline graphite, which were then dispersed by means of a sand mill making use of glass beads. To the resultant dispersion, the above treated silica, having been dispersed in the remaining IPA, was further added as a filler, followed by further dispersion with a sand mill to obtain a coating material.

Next, in the same manner as in Developing Sleeve Production Example 1, this coating material was coated on a sleeve substrate to form a coat layer, followed by surface polishing. The coated layer thus formed had a layer thickness of 15 μm, a surface roughness Ra of 1.08 μm on the 6-point average and a volume resistivity of 7 Ω·cm. Its pencil hardness was also measured to find that it was 3 H. To this sleeve, a magnet was inserted and flanges were attached to both ends to obtain developing sleeve 2.

Developing Sleeve

Production Example 3

The same coating material as used in Developing Sleeve Production Example 1 was used. As the sleeve substrate used, the surface of a cylindrical aluminum pipe of 16 mm in external diameter and 0.8 mm in wall thickness was put to polishing to make the cylindrical pipe have a rotational deflection of 10 μm or less and a surface roughness of 4 μm or less as expressed by Ra. This sleeve substrate was set upright and rotated at a constant speed and also its upper and lower ends were masked, where the coating material was coated while descending a spray gun at a constant speed. The masking at each end of the sleeve was set in a width of 3 mm. The sleeve thus coated was dried in a drying furnace at 160° C. for 20 minutes to cause the coating to harden. Thereafter, the surface of the sleeve thus resin-coated was rubbed with a belt-like felt under a pressing load of 4 kgf to polish the surface. Thus, a sleeve with a coat layer having a uniform layer thickness was obtained.

This coated layer had a layer thickness of 11 μm, a surface roughness Ra of 0.97 μm on the 6-point average and a volume resistivity of 4 Ω·cm. Its pencil hardness was also measured to find that it was 2 H. Flanges were attached to both ends of this sleeve to obtain developing sleeve 3.

Developing Sleeve

Production Example 4

As the sleeve substrate used, the surface of a cylindrical stainless steel pipe of 20 mm in external diameter and 0.8 mm in wall thickness was put to polishing to make the cylindrical pipe have a rotational deflection of 10 μm or less and a surface roughness of 4 μm or less as expressed by Ra. This sleeve substrate was masked at its upper and lower ends and was put to blasting using amorphous alumina abrasive grains (#300) by means of a blasting machine under a blast pressure of $3.92\times10^{-2}$ MPa (4.0 kgf/cm). The masking at each end of the sleeve was set in a width of 3 mm. This blast-treated sleeve had a surface roughness Ra of 1.12 μm on the 6-point average. To this sleeve, a magnet was inserted and flanges were attached to both ends to obtain developing sleeve 4.

| Example 1 | (by weight) |
|---|---|
| Binder resin A | 100 parts |
| Magnetite (octahedron; average particle diameter: 0.22 μm; BET specific surface area: 7.9 $m^2/g$; silicon content: 0.35% by weight; σs: 84.5 $Am^2/kg$; σr: 10.9 $Am^2/kg$) | 90 parts |
| Low-molecular-weight polypropylene wax (melting point: 130° C.) | 4 parts |
| Imidazole derivative, exemplary compound (1) | 2 parts |

The above materials were well premixed by means of a Henschel mixer, and thereafter the mixture obtained was melt-kneaded using a twin-screw extruder set at 140° C. The kneaded product obtained was cooled, and then crushed using a cutter mill. Thereafter, the crushed product was finely pulverized using a pulverizer making use of jet streams. The finely pulverized product thus obtained was further classified using an air classifier to obtain a classified fine powder (toner particles) with a weight-average particle diameter of 8.5 μm.

To 100 parts by weight of the classified fine powder thus obtained, 0.8 part by weight of hydrophobic silica obtained by treating 100 parts by weight of silica fine powder produced by dry process (BET specific surface area: 200 $m^2/g$), with 17 parts by weight of amino-modified silicone oil (amine equivalent weight: 830; viscosity at 25° C.: 70 cSt) was added, which were then mixed with a Henschel mixer, followed by sieving with a 150 μm mesh sieve to obtain positive-chargeable toner 1, which was used as positive-chargeable one-component magnetic developer 1.

The developer 1 thus obtained was tested to make evaluation on the following.

Anti-Offset Properties Evaluation Test

As the image forming apparatus shown in FIG. 5, a commercially available copying machine NP6030 (manufactured by CANON INC.) was used. The fixing assembly of this NP6030 was detached to the outside, and unfixed images were formed on transfer paper. Using an external fixing assembly so modified as to be operable outside the copying machine, be able to be set at any desired fixing roller temperature and have a process speed of 100 mm/sec, the unfixed images were passed therethrough to examine whether or not offset occurred, to evaluate anti-offset properties. The fixing roller temperature was set at 230° C. Evaluation was made according to the following evaluation criteria (evaluation environment: normal temperature/normal humidity, 23° C./60% RH).

Anti-offset Evaluation Criteria

A: Offset is not seen at all.

B: Offset is very slightly seen.

C: Offset occurs.

Image Evaluation Test

As the image forming apparatus shown in FIG. 5, a commercially available copying machine NP6030 (manufactured by CANON INC.) was used. Its developing sleeve was replaced with the developing sleeve 1. Character images having an image area percentage of 6% were copied on 10,000 sheets in an environment of normal temperature/normal humidity. Character images having an image area percentage of 6% were also copied on 5,000 sheets in each of an environment of normal temperature/low humidity and an environment of high temperature/high humidity to evaluate image density and fog (evaluation environment: normal temperature/normal humidity, 23° C./60% RH; normal temperature/low humidity, 23° C./5% RH; high temperature/high humidity, 32.5° C./80% RH).

The image density was measured by copying a solid black image and using Macbeth Reflection Densitometer (manufactured by Macbeth Co.) on 10 points of the solid black image areas and evaluated as their average value. With regard to the fog, using Reflection Densitometer (manufactured by Tokyo Denshoku Gijutsu Center K.K.), a 10-point average value (Dr) of reflection density of transfer paper before image formation and a 10-point average value (Ds) of reflection density of transfer paper after copying of solid white images were measured, and their difference (Ds−Dr) was regarded as the value of fog. Evaluation was made according to the following evaluation criteria.

Fog Evaluation Criteria

A: Less than 0.5%.

B: From 0.5% to 1.0%.

BB: From 1.0% to 2.0%.

C: More than 2.0%.

Character images having an image area percentage of 6% were further copied on 10,000 sheets in an environment of normal temperature/normal humidity. Thereafter, part of the developing sleeve surface was wiped up with ethanol to clean. Using the developing sleeve thus cleaned, the solid black images were again copied to measure image density of the solid black images before and after the wiping with ethanol. Their difference was calculated to make evaluation on sleeve contamination according to the following evaluation criteria.

Sleeve Evaluation Criteria

A: Difference is less than 0.03.

B: Difference is from 0.03 to less than 0.10

BB: Difference is from more than 0.10 to 0.20.

C: Difference is more than 0.20.

Character images having an image area percentage of 6% were further copied on 10,000 sheets in an environment of normal temperature/normal humidity, and thereafter copied on 5,000 sheets in each of an environment of normal temperature/low humidity and an environment of high temperature/high humidity. Thereafter, how the toner stands coated on the developing sleeve was visually observed to evaluate sleeve coat performance according to whether or not blotches occurred. Evaluation was made according to the following criteria (evaluation environment: normal temperature/normal humidity, 23° C./60% RH; normal temperature/low humidity, 23° C./5% RH; high temperature/high humidity, 32.5° C./80% RH).

Sleeve Coat Performance Evaluation Criteria

A: No blotch occurs at all.

B: Blotches slightly occur at sleeve ends.

BB: Blotches slightly occur but do not affect images.

C: Blotches conspicuously occur to affect images.

The results of each evaluation are shown in Table 1.

Example 2

Positive-chargeable toner 2 was obtained in the same manner as in Example 1 except that the binder resin A was replaced with the binder resin B. This positive-chargeable toner 2 was used as positive-chargeable one-component magnetic developer 2. Evaluation was made in the same manner as in Example 1.

The results of evaluation are summarized in Table 1.

Example 3

Positive-chargeable toner 3 was obtained in the same manner as in Example 1 except that the binder resin A was replaced with the binder resin C. This positive-chargeable toner 3 was used as positive-chargeable one-component magnetic developer 3. Evaluation was made in the same manner as in Example 1.

The results of evaluation are summarized in Table 1.

Example 4

Positive-chargeable toner 4 was obtained in the same manner as in Example 1 except that the binder resin A was replaced with the binder resin D. This positive-chargeable toner 4 was used as positive-chargeable one-component magnetic developer 4. Evaluation was made in the same manner as in Example 1.

The results of evaluation are summarized in Table 1.

Example 5

Positive-chargeable toner 5 was obtained in the same manner as in Example 1 except that the binder resin A was replaced with the binder resin E. This positive-chargeable toner 5 was used as positive-chargeable one-component magnetic developer 5. Evaluation was made in the same manner as in Example 1.

The results of evaluation are summarized in Table 1.

Comparative Example 1

Positive-chargeable toner 6 was obtained in the same manner as in Example 1 except that the binder resin A was replaced with the binder resin F. This positive-chargeable toner 6 was used as positive-chargeable one-component magnetic developer 6. Evaluation was made in the same manner as in Example 1.

The results of evaluation are summarized in Table 1.

Comparative Example 2

Positive-chargeable toner 7 was obtained in the same manner as in Example 1 except that the binder resin A was replaced with the binder resin G. This positive-chargeable toner 7 was used as positive-chargeable one-component magnetic developer 7. Evaluation was made in the same manner as in Example 1.

The results of evaluation are summarized in Table 1.

Example 6

Positive-chargeable toner 8 was obtained in the same manner as in Example 1 except that the exemplary compound (1) of the imidazole derivative was replaced with the exemplary compound (10). This positive-chargeable toner 8 was used as positive-chargeable one-component magnetic developer 8. Evaluation was made in the same manner as in Example 1.

The results of evaluation are summarized in Table 1.

Example 7

Positive-chargeable toner 9 was obtained in the same manner as in Example 1 except that the exemplary compound (1) of the imidazole derivative was replaced with the exemplary compound (5). This positive-chargeable toner 9 was used as positive-chargeable one-component magnetic developer 9. Evaluation was made in the same manner as in Example 1.

The results of evaluation are summarized in Table 1.

Example 8

Positive-chargeable toner 10 was obtained in the same manner as in Example 1 except that the exemplary compound (1) of the imidazole derivative was replaced with the exemplary compound (6). This positive-chargeable toner 10 was used as positive-chargeable one-component magnetic developer 10. Evaluation was made in the same manner as in Example 1.

The results of evaluation are summarized in Table 1.

Example 9

Positive-chargeable toner 11 was obtained in the same manner as in Example 1 except that the exemplary compound (1) of the imidazole derivative was replaced with the exemplary compound (15). This positive-chargeable toner 11 was used as positive-chargeable one-component magnetic developer 11. Evaluation was made in the same manner as in Example 1.

The results of evaluation are summarized in Table 1.

Example 10

Positive-chargeable toner 12 was obtained in the same manner as in Example 1 except that the exemplary compound (1) of the imidazole derivative was replaced with the exemplary compound (16). This positive-chargeable toner 12 was used as positive-chargeable one-component magnetic developer 12. Evaluation was made in the same manner as in Example 1.

The results of evaluation are summarized in Table 1.

Example 11

Positive-chargeable toner 13 was obtained in the same manner as in Example 1 except that the exemplary compound (1) of the imidazole derivative was replaced with the exemplary compound (11). This positive-chargeable toner 13 was used as positive-chargeable one-component magnetic developer 13. Evaluation was made in the same manner as in Example 1.

The results of evaluation are summarized in Table 1.

Example 12

Positive-chargeable toner 14 was obtained in the same manner as in Example 1 except that the exemplary compound (1) of the imidazole derivative was replaced with the exemplary compound (12). This positive-chargeable toner 14 was used as positive-chargeable one-component magnetic developer 14. Evaluation was made in the same manner as in Example 1.

The results of evaluation are summarized in Table 1.

Example 13

Positive-chargeable toner 15 was obtained in the same manner as in Example 1 except that the exemplary compound (1) of the imidazole derivative was replaced with the exemplary compound (13). This positive-chargeable toner 15 was used as positive-chargeable one-component magnetic developer 15. Evaluation was made in the same manner as in Example 1.

The results of evaluation are summarized in Table 1.

Example 14

Positive-chargeable toner 16 was obtained in the same manner as in Example 1 except that the exemplary compound (1) of the imidazole derivative was replaced with the exemplary compound (14). This positive-chargeable toner 16 was used as positive-chargeable one-component magnetic developer 16. Evaluation was made in the same manner as in Example 1.

The results of evaluation are summarized in Table 1.

Example 15

Positive-chargeable toner 17 was obtained in the same manner as in Example 1 except that the exemplary compound (1) of the imidazole derivative was replaced with a compound represented by the following formula. This positive-chargeable toner 17 was used as positive-chargeable one-component magnetic developer 17. Evaluation was made in the same manner as in Example 1.

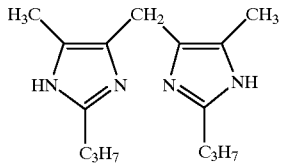

Example 16

Positive-chargeable toner 18 was obtained in the same manner as in Example 1 except that the exemplary compound (1) of the imidazole derivative was replaced with a compound represented by the following formula. This positive-chargeable toner 18 was used as positive-chargeable one-component magnetic developer 18. Evaluation was made in the same manner as in Example 1.

The results of evaluation are summarized in Table 1.

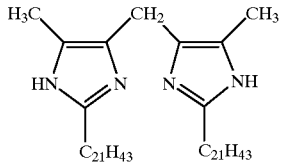

Comparative Example 3

Positive-chargeable toner 19 was obtained in the same manner as in Example 1 except that the exemplary compound (1) of the imidazole derivative was replaced with a Nigrosine dye. This positive-chargeable toner 19 was used as positive-chargeable one-component magnetic developer 19. Evaluation was made in the same manner as in Example 1.

The results of evaluation are summarized in Table 1.

Example 17

Evaluation tests were made in the same manner as in Example 1 except that the developing sleeve 1 was replaced with the developing sleeve 2.

The results of evaluation are summarized in Table 1.

Example 18

Evaluation tests were made in the same manner as in Example 1 except that the developing sleeve 1 was replaced with the developing sleeve 4.

The results of evaluation are summarized in Table 1.

Comparative Example 4

Positive-chargeable toner 20 was obtained in the same manner as in Example 1 except that the binder resin A was replaced with the binder resin H. This positive-chargeable toner 20 was used as positive-chargeable one-component magnetic developer 20, and evaluation was also made in the same manner as in Example 1 except that the developing sleeve 1 was replaced with the developing sleeve 4.

The results of evaluation are summarized in Table 1.

Comparative Example 5

Positive-chargeable toner 21 was obtained in the same manner as in Example 1 except that the binder resin A was replaced with the binder resin I. This positive-chargeable toner 21 was used as positive-chargeable one-component magnetic developer 21, and evaluation was also made in the same manner as in Example 1 except that the developing sleeve 1 was replaced with the developing sleeve 4.

The results of evaluation are summarized in Table 1.

| Example 18 | (by weight) |
|---|---|
| Binder resin A | 100 parts |
| Copper phthalocyanine | 3.5 parts |
| Low-molecular-weight polypropylene wax (melting point: 130° C.) | 3 parts |
| Imidazole derivative, exemplary compound (1) | 2 parts |

The above materials were well premixed by means of a Henschel mixer, and thereafter the mixture obtained was melt-kneaded using a twin-screw extruder set at 120° C. The kneaded product obtained was cooled, and then crushed using a cutter mill. Thereafter, the crushed product was finely pulverized using a pulverizer making use of jet streams. The finely pulverized product thus obtained was further classified using an air classifier to obtain a classified fine powder (toner particles) with a weight-average particle diameter of 8.5 $\mu$m.

To 100 parts by weight of the classified fine powder thus obtained, 1.0 part by weight of hydrophobic silica obtained by treating 100 parts by weight of silica fine powder produced by dry process (BET specific surface area: 200 $m^2/g$), with 17 parts by weight of amino-modified silicone oil (amine equivalent weight: 830; viscosity at 25° C.: 70 cSt) was added, which were then mixed with a Henschel mixer, followed by sieving with a 150 $\mu$m mesh sieve to obtain positive-chargeable toner 22, which was used as positive-chargeable one-component non-magnetic developer 22.

Using a commercially available copying machine FC-330 (manufactured by CANON INC.) whose developing sleeve was replaced with the developing sleeve 3, character images having an image area percentage of 6% were copied on 1,000 sheets in each of an environment of normal temperature/normal humidity, an environment of normal temperature/low humidity and an environment of high temperature/high humidity to evaluate image density and fog in the same manner as in Example 1 (evaluation environment: normal temperature/normal humidity, 23° C./60% RH; normal temperature/low humidity, 23° C./5% RH; high temperature/high humidity, 32.5° C./80% RH).

Character images having an image area percentage of 6% were further copied on 1,000 sheets in an environment of normal temperature/normal humidity. Thereafter, part of the developing sleeve surface was wiped up with ethanol to clean. Evaluation was made on sleeve contamination in the same manner as in Example 1.

Character images having an image area percentage of 6% were further copied on 1,000 sheets in each of an environment of normal temperature/normal humidity, an environment of normal temperature/low humidity and an environment of high temperature/high humidity. Thereafter, evaluation was made on sleeve coat performance in the same manner as in Example 1.

The results of evaluation are shown in Table 2.

TABLE 1

| | Developer | Resin | Binder resin acid | Imidazole comp. | Developing sleeve | N/N (23° C./60% RH) After 10,000 sheets | | | | | N/L (23° C./5% RH) After 5,000 sh. | | | H/H (32.5° C./80% RH) After 5,000 sh. | | |
|---|---|---|---|---|---|---|---|---|---|---|---|---|---|---|---|---|
| | No. | No. | value | No. | No. | (1) | (2) | (3) | (4) | Fog | (2) | (4) | Fog | (2) | (4) | Fog |
| Example: | | | | | | | | | | | | | | | | |
| 1 | 1 | A | 5.2 | 1 | 1 | A | A | A | 1.41 | A | A | 1.40 | B | A | 1.37 | B |
| 2 | 2 | B | 2.3 | 1 | 1 | B | A | A | 1.42 | A | A | 1.41 | B | A | 1.37 | B |
| 3 | 3 | C | 18.8 | 1 | 1 | A | A | A | 1.41 | A | A | 1.40 | B | A | 1.36 | B |
| 4 | 4 | D | 27.0 | 1 | 1 | A | A | A | 1.39 | B | B | 1.40 | BB | A | 1.31 | B |
| 5 | 5 | E | 34.8 | 1 | 1 | A | A | B | 1.35 | B | B | 1.38 | BB | A | 1.26 | BB |
| Comparative Example: | | | | | | | | | | | | | | | | |
| 1 | 6 | F | 0.1 | 1 | 1 | C | B | A | 1.18 | BB | BB | 1.20 | C | A | 1.07 | C |
| 2 | 7 | G | 55.2 | 1 | 1 | A | B | A | 1.16 | BB | B | 1.14 | C | A | 1.06 | BB |
| Example: | | | | | | | | | | | | | | | | |
| 6 | 8 | A | 5.2 | 10 | 1 | A | A | A | 1.41 | A | A | 1.40 | B | A | 1.38 | B |
| 7 | 9 | A | 5.2 | 5 | 1 | A | A | A | 1.39 | A | A | 1.40 | B | A | 1.36 | B |
| 8 | 10 | A | 5.2 | 6 | 1 | A | A | A | 1.39 | A | A | 1.39 | B | A | 1.37 | B |
| 9 | 11 | A | 5.2 | 15 | 1 | A | A | A | 1.38 | B | A | 1.36 | B | A | 1.34 | B |
| 10 | 12 | A | 5.2 | 16 | 1 | A | A | A | 1.37 | B | A | 1.35 | B | A | 1.34 | B |
| 11 | 13 | A | 5.2 | 11 | 1 | A | A | A | 1.37 | B | A | 1.34 | BB | A | 1.35 | B |
| 12 | 14 | A | 5.2 | 12 | 1 | A | B | A | 1.35 | B | B | 1.35 | BB | A | 1.33 | B |
| 13 | 15 | A | 5.2 | 13 | 1 | A | A | A | 1.36 | B | A | 1.35 | BB | A | 1.32 | BB |
| 14 | 16 | A | 5.2 | 14 | 1 | A | A | A | 1.35 | B | B | 1.35 | BB | A | 1.31 | B |
| 15 | 17 | A | 5.2 | *1 | 1 | A | B | B | 1.31 | B | B | 1.31 | BB | B | 1.20 | BB |
| 16 | 18 | A | 5.2 | *2 | 1 | A | B | BB | 1.30 | BB | B | 1.31 | BB | B | 1.25 | BB |
| Comparative Example: | | | | | | | | | | | | | | | | |
| 3 | 19 | A | 5.2 | *3 | 1 | A | B | C | 0.96 | BB | BB | 0.98 | C | B | 0.83 | C |

TABLE 1-continued

| | Developer | Resin | Binder resin acid | Imidazole comp. | Developing sleeve | N/N (23° C./60% RH) After 10,000 sheets | | | | | N/L (23° C./5% RH) After 5,000 sh. | | | H/H (32.5° C./80% RH) After 5,000 sh. | | |
|---|---|---|---|---|---|---|---|---|---|---|---|---|---|---|---|---|
| | No. | No. | value | No. | No. | (1) | (2) | (3) | (4) | Fog | (2) | (4) | Fog | (2) | (4) | Fog |
| Example: | | | | | | | | | | | | | | | | |
| 17 | 1 | A | 5.2 | 1 | 2 | A | A | A | 1.42 | A | A | 1.40 | B | A | 1.37 | A |
| 18 | 1 | A | 5.2 | 1 | 4 | A | B | BB | 1.26 | BB | B | 1.27 | BB | B | 1.16 | BB |
| Comparative Example: | | | | | | | | | | | | | | | | |
| 4 | 20 | H | 1.0 | 1 | 4 | B | B | BB | 1.12 | BB | B | 1.22 | C | B | 1.02 | BB |
| 5 | 21 | I | 5.5 | 1 | 4 | A | B | BB | 1.08 | BB | B | 1.18 | C | B | 0.96 | BB |

N/N: Normal temperature/normal humidity;
N/L: Normal temperature/low humidity
H/H: High temperature/high humidity
(1): Anti-offset properties;
(2): Sleeve coat performance;
(3): Sleeve contamination
(4): Image density
*1: Imidazole derivative compound (1) in which $C_{11}H_{23}$ is replaced with $C_3H_7$
*2: Imidazole derivative compound (1) in which $C_{11}H_{23}$ is replaced with $C_{21}H_{43}$
*3: Nigrosine dye

TABLE 2

| | Developer | Resin | Binder resin acid | Imidazole comp. | Developing sleeve | N/N (23° C./60% RH) After 10,000 sheets | | | | N/L (23° C./5% RH) After 5,000 sh. | | | H/H (32.5° C./80% RH) After 5,000 sh. | | |
|---|---|---|---|---|---|---|---|---|---|---|---|---|---|---|---|
| | No. | No. | value | No. | No. | (2) | (3) | (4) | Fog | (2) | (4) | Fog | (2) | (4) | Fog |
| Example: | | | | | | | | | | | | | | | |
| 19 | 22 | A | 5.2 | 1 | 3 | A | A | 1.30 | B | A | 1.25 | B | A | 1.20 | B |

N/N: Normal temperature/normal humidity;
N/L: Normal temperature/low humidity
H/H: High temperature/high humidity
(2): Sleeve coat performance;
(3): Sleeve contamination
(4): Image density

What is claimed is:

1. A positive-chargeable toner comprising a binder resin, a colorant and a charge control agent, wherein;

said binder resin contains a styrene copolymer and has an acid value of from 0.5 to 50.0 mg KOH/g; and said charge control agent has an imidazole derivative represented by the following Formula (1):

(1)

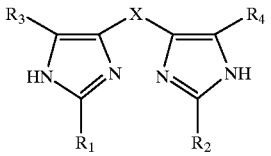

wherein $R_1$, $R_2$, $R_3$ and $R_4$ each represent a substituent selected from the group consisting of a hydrogen atom, an alkyl group, an aralkyl group and an aryl group, which are the same or different from one another and may further be substituted with a substituent; and X represents a connecting group selected from the group consisting of a phenylene group, a propenylene group, a vinylene group, an alkylene group and —$CR_5R_6$—, where $R_5$ and $R_6$ each represent a substituent selected from the group consisting of a hydrogen atom, an alkyl group, an aralkyl group and an aryl group.

2. The positive-chargeable toner according to claim 1, wherein said binder resin has an acid value of from 0.5 mg KOH/g to 30.0 mg KOH/g.

3. The positive-chargeable toner according to claim 1, wherein said binder resin has an acid value of from 0.5 mg KOH/g to 20.0 mg KOH/g.

4. The positive-chargeable toner according to claim 1, wherein said binder resin has an acid value of from more than 5 mg KOH/g to not more than 20.0 mg KOH/g.

5. The positive-chargeable toner according to claim 1, wherein said styrene copolymer contains at least a styrene monomer unit and a carboxyl group or acid anhydride group-containing monomer unit.

6. The positive-chargeable toner according to claim 1, wherein said styrene copolymer contains at least a styrene monomer unit, a carboxyl group or acid anhydride group-containing monomer unit and other vinyl monomer unit.

7. The positive-chargeable toner according to claim 5, wherein said carboxyl group or acid anhydride group-containing monomer is selected from the group consisting of acrylic acid, an α-alkyl derivative of acrylic acid, a β-alkyl derivative of acrylic acid, an unsaturated dicarboxylic acid, a monoester derivative of an unsaturated dicarboxylic acid and an anhydride of an unsaturated dicarboxylic acid.

8. The positive-chargeable toner according to claim 5, wherein said carboxyl group or acid anhydride group-containing monomer is a monoester derivative of an unsaturated dicarboxylic acid.

9. The positive-chargeable toner according to claim 8, wherein said monoester derivative of an unsaturated dicarboxylic acid is selected from the group consisting of a monoester of an α,β-unsaturated dicarboxylic acid and a monoester of an alkenyldicarboxylic acid.

10. The positive-chargeable toner according to claim 5, wherein said binder resin is synthesized by the use of said carboxyl group or acid anhydride group-containing monomer in an amount of from 0.1 part by weight to 20 parts by weight based on 100 parts by weight of the whole monomers constituting the binder resin.

11. The positive-chargeable toner according to claim 5, wherein said styrene monomer is selected from the group consisting of styrene and a styrene derivative.

12. The positive-chargeable toner according to claim 11, wherein said styrene derivative is selected from the group consisting of o-methylstyrene, m-methylstyrene, p-methylstyrene, p-methoxystyrene, p-phenylstyrene, p-chlorostyrene, 3,4-dichlorostyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene and p-n-dodecylstyrene.

13. The positive-chargeable toner according to claim 6, wherein said other vinyl monomer comprises an acrylate.

14. The positive-chargeable toner according to claim 1, wherein said styrene copolymer contains at least a styrene monomer unit and a carboxyl group or acid anhydride group-containing monomer unit, and the carboxylic acid group, acid anhydride group or carboxylate ester moiety in the styrene copolymer has been saponified by alkali treatment.

15. The positive-chargeable toner according to claim 1, wherein said binder resin comprises a resin composition which is a mixture of a high-molecular-weight polymer component and a low-molecular-weight polymer component.

16. The positive-chargeable toner according to claim 15, wherein said high-molecular-weight polymer component and said low-molecular-weight polymer component each contain the styrene copolymer in an amount not less than 65% by weight.

17. The positive-chargeable toner according to claim 15, wherein said resin composition is synthesized by (i) a solution blend method in which a high-molecular-weight polymer component synthesized by solution polymerization or suspension polymerization and a low-molecular-weight polymer component synthesized by solution polymerization are mixed in the state of a solution without solvent removal, followed by solvent removal, (ii) a dry blend method in which a high-molecular-weight polymer component synthesized by solution polymerization or suspension polymerization and a low-molecular-weight polymer component synthesized by solution polymerization are subjected to solvent removal and thereafter melt-kneaded or (iii) a two-stage polymerization method in which a low-molecular-weight polymer synthesized by solution polymerization is dissolved in monomers for constituting a high-molecular-weight polymer component to polymerize the monomers to synthesize the high-molecular-weight polymer.

18. The positive-chargeable toner according to claim 1, wherein said binder resin contains whole styrene resins including said styrene copolymer in an amount of not less than 60% by weight based on the weight of the whole binder resin.

19. The positive-chargeable toner according to claim 1, which further comprises a wax.

20. The positive-chargeable toner according to claim 19, wherein said wax has a melting point of from 70° C. to 165° C.

21. The positive-chargeable toner according to claim 19, wherein said wax is contained in the positive-chargeable toner in an amount of from 0.5 part by weight to 10 parts by weight based on 100 parts by weight of the binder resin.

22. The positive-chargeable toner according to claim 1, wherein said imidazole derivative comprises a compound represented by the following Formula (2):

(2)

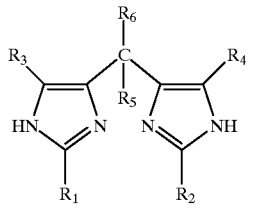

wherein $R_1$ and $R_2$ each represent a substituent selected from the group consisting of an alkyl group having 5 to 20 carbon atoms, an aralkyl group having 5 to 20 carbon atoms and an aryl group having 6 to 20 carbon atoms, which are the same or different from each other and may each be substituted with a substituent; and $R_3$, $R_4$, $R_5$ and $R_6$ each represent a substituent selected from the group consisting of a hydrogen atom, an alkyl group, an aralkyl group and an aryl group, which are the same or different from one another and may each be substituted with a substituent.

23. The positive-chargeable toner according to claim 1, wherein said imidazole derivative comprises a compound represented by the following Formula (3):

(3)

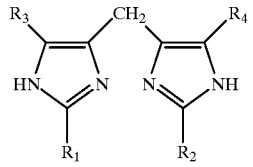

wherein $R_1$ and $R_2$ each represent a substituent selected from the group consisting of an alkyl group having 5 to 20 carbon atoms, an aralkyl group having 5 to 20 carbon atoms and an aryl group having 6 to 20 carbon atoms, which are the same or different from each other and may each be substituted with a substituent; and $R_3$ and $R_4$ each represent a substituent selected from the group consisting of a hydrogen atom, an alkyl group, an aralkyl group and an aryl group, which are the same or different from each other and may each be substituted with a substituent.

24. The positive-chargeable toner according to claim 1, wherein said imidazole derivative is contained in the positive-chargeable toner in an amount of from 0.01 part by weight to 20.0 parts by weight based on 100 parts by weight of the binder resin.

25. The positive-chargeable toner according to claim 1, which is a non-magnetic toner containing a pigment or a dye as the colorant.

26. The positive-chargeable toner according to claim 1, which is a magnetic toner containing a magnetic material as the colorant.

27. The positive-chargeable toner according to claim 26, wherein said magnetic material is contained in the positive-chargeable toner in an amount of from 10 parts by weight to 200 parts by weight based on 100 parts by weight of the binder resin.

28. The positive-chargeable toner according to claim 26, wherein said magnetic material contains silicon element in an amount of from 0.05% by weight to 10% by weight based on the weight of the magnetic material.

29. The positive-chargeable toner according to claim 1, which further comprises a fine silica powder externally added.

30. The positive-chargeable toner according to claim 1, which has a weight-average particle diameter of from 3 $\mu$m to 10 $\mu$m.

31. An image forming method comprising the steps of;

forming an electrostatic latent image on an electrostatic latent image bearing member; and developing the electrostatic latent image by the use of a one-component developer having a positive-chargeable toner, carried and transported on the surface of a developer carrying member;

said developer carrying member having at least a surface formed of a material containing a resin; and said positive-chargeable toner comprising a binder resin, a colorant and a charge control agent, wherein;

said binder resin contains a styrene copolymer and has an acid value of from 0.5 to 50.0 mg KOH/g; and said charge control agent has an imidazole derivative represented by the following Formula (1):

(1)

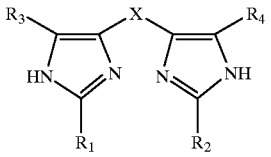

wherein $R_1$, $R_2$, $R_3$ and $R_4$ each represent a substituent selected from the group consisting of a hydrogen atom, an alkyl group, an aralkyl group and an aryl group, which are the same or different from one another and may further be substituted with a substituent; and X represents a connecting group selected from the group consisting of a phenylene group, a propenylene group, a vinylene group, an alkylene group and —$CR_5R_6$—, where $R_5$ and $R_6$ each represent a substituent selected from the group consisting of a hydrogen atom, an alkyl group, an aralkyl group and an aryl group.

32. The image forming method according to claim 31, wherein said binder resin has an acid value of from 0.5 mg KOH/g to 30.0 mg KOH/g.

33. The image forming method according to claim 31, wherein said binder resin has an acid value of from 0.5 mg KOH/g to 20.0 mg KOH/g.

34. The image forming method according to claim 31, wherein said binder resin has an acid value of from more than 5 mg KOH/g to not more than 20.0 mg KOH/g.

35. The image forming method according to claim 31, wherein said styrene copolymer contains at least a styrene monomer unit and a carboxyl group or acid anhydride group-containing monomer unit.

36. The image forming method according to claim 31, wherein said styrene copolymer contains at least a styrene monomer unit, a carboxyl group or acid anhydride group-containing monomer unit and other vinyl monomer unit.

37. The image forming method according to claim 35, wherein said carboxyl group or acid anhydride group-containing monomer is selected from the group consisting of acrylic acid, an $\alpha$-alkyl derivative of acrylic acid, a $\beta$-alkyl derivative of acrylic acid, an unsaturated dicarboxylic acid, a monoester derivative of an unsaturated dicarboxylic acid and an anhydride of an unsaturated dicarboxylic acid.

38. The image forming method according to claim 35, wherein said carboxyl group or acid anhydride group-containing monomer is a monoester derivative of an unsaturated dicarboxylic acid.

39. The image forming method according to claim 38, wherein said monoester derivative of an unsaturated dicarboxylic acid is selected from the group consisting of a monoester of an $\alpha,\beta$-unsaturated dicarboxylic acid and a monoester of an alkenyldicarboxylic acid.

40. The image forming method according to claim 35, wherein said binder resin is synthesized by the use of said carboxyl group or acid anhydride group-containing monomer in an amount of from 0.1 part by weight to 20 parts by weight based on 100 parts by weight of the whole monomers constituting the binder resin.

41. The image forming method according to claim 35, wherein said styrene monomer is selected from the group consisting of styrene and a styrene derivative.

42. The image forming method according to claim 41, wherein said styrene derivative is selected from the group consisting of o-methylstyrene, m-methylstyrene, p-methylstyrene, p-methoxystyrene, p-phenylstyrene, p-chlorostyrene, 3,4-dichlorostyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene and p-n-dodecylstyrene.

43. The image forming method according to claim 36, wherein said other vinyl monomer comprises an acrylate.

44. The image forming method according to claim 31, wherein said styrene copolymer contains at least a styrene monomer unit and a carboxyl group or acid anhydride group-containing monomer unit, and the carboxylic acid group, acid anhydride group or carboxylate ester moiety in the styrene copolymer has been saponified by alkali treatment.

45. The image forming method according to claim 31, wherein said binder resin comprises a resin composition which is a mixture of a high-molecular-weight polymer component and a low-molecular-weight polymer component.

46. The image forming method according to claim 45, wherein said high-molecular-weight polymer component and said low-molecular-weight polymer component each contain the styrene copolymer in an amount not less than 65% by weight.

47. The image forming method according to claim 45, wherein said resin composition is synthesized by (i) a solution blend method in which a high-molecular-weight polymer component synthesized by solution polymerization or suspension polymerization and a low-molecular-weight polymer component synthesized by solution polymerization are mixed in the state of a solution without solvent removal, followed by solvent removal, (ii) a dry blend method in which a high-molecular-weight polymer component synthesized by solution polymerization or suspension polymerization and a low-molecular-weight polymer component synthesized by solution polymerization are subjected to solvent removal and thereafter melt-kneaded or (iii) a two-stage polymerization method in which a low-molecular-weight polymer synthesized by solution polymerization is dissolved in monomers for constituting a high-molecular-weight polymer component to polymerize the monomers to synthesize the high-molecular-weight polymer.

48. The image forming method according to claim 31, wherein said binder resin contains whole styrene resins including said styrene copolymer in an amount of not less than 60% by weight based on the weight of the whole binder resin.

49. The image forming method according to claim 31, wherein said positive-chargeable toner further comprises a wax.

50. The image forming method according to claim 49, wherein said wax has a melting point of from 70° C. to 165° C.

51. The image forming method according to claim 49, wherein said wax is contained in the positive-chargeable toner in an amount of from 0.5 part by weight to 10 parts by weight based on 100 parts by weight of the binder resin.

52. The image forming method according to claim 31, wherein said imidazole derivative comprises a compound represented by the following Formula (2):

(2)

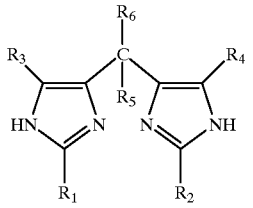

wherein $R_1$ and $R_2$ each represent a substituent selected from the group consisting of an alkyl group having 5 to 20 carbon atoms, an aralkyl group having 5 to 20 carbon atoms and an aryl group having 6 to 20 carbon atoms, which are the same or different from each other and may each be substituted with a substituent; and $R_3$, $R_4$, $R_5$ and $R_6$ each represent a substituent selected from the group consisting of a hydrogen atom, an alkyl group, an aralkyl group and an aryl group, which are the same or different from one another and may each be substituted with a substituent.

53. The image forming method according to claim 31, wherein said imidazole derivative comprises a compound represented by the following Formula (3):

(3)

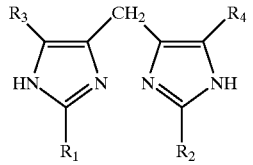

wherein $R_1$ and $R_2$ each represent a substituent selected from the group consisting of an alkyl group having 5 to 20 carbon atoms, an aralkyl group having 5 to 20 carbon atoms and an aryl group having 6 to 20 carbon atoms, which are the same or different from each other and may each be substituted with a substituent; and $R_3$ and $R_4$ each represent a substituent selected from the group consisting of a hydrogen atom, an alkyl group, an aralkyl group and an aryl group, which are the same or different from each other and may each be substituted with a substituent.

54. The image forming method according to claim 31, wherein said imidazole derivative is contained in the positive-chargeable toner in an amount of from 0.01 part by weight to 20.0 parts by weight based on 100 parts by weight of the binder resin.

55. The image forming method according to claim 31, wherein said positive-chargeable toner is a non-magnetic toner containing a pigment or a dye as the colorant.

56. The image forming method according to claim 31, wherein said positive-chargeable toner is a magnetic toner containing a magnetic material as the colorant.

57. The image forming method according to claim 56, wherein said magnetic material is contained in the positive-chargeable toner in an amount of from 10 parts by weight to 200 parts by weight based on 100 parts by weight of the binder resin.

58. The image forming method according to claim 56, wherein said magnetic material contains silicon element in an amount of from 0.05% by weight to 10% by weight based on the weight of the magnetic material.

59. The image forming method according to claim 31, wherein said positive-chargeable toner further comprises a fine silica powder externally added.

60. The image forming method according to claim 31, wherein said positive-chargeable toner has a weight-average particle diameter of from 3 $\mu$m to 10 $\mu$m.

61. The image forming method according to claim 55, wherein said non-magnetic toner is used as a one-component non-magnetic developer.

62. The image forming method according to claim 56, wherein said magnetic toner is used as a one-component magnetic developer.

63. The image forming method according to claim 31, wherein said developer carrying member is a cylindrical sleeve formed of a material containing a resin.

64. The image forming method according to claim 31, wherein said developer carrying member has a substrate and a coat layer containing a resin formed on the substrate.

65. The image forming method according to claim 64, wherein said coat layer further contains at least one member selected from the group consisting of a conductive material, a filler, and a solid lubricant.

66. The image forming method according to claim 31, wherein said electrostatic latent image bearing member is an electrophotographic photosensitive member.

67. An apparatus unit detachably mountable on a main assembly of an image forming apparatus; said unit comprising;

a one-component developer having at least a positive-chargeable toner;

a developer container for holding the one-component developer; and a developer carrying member for carrying the one-component developer held in the developer container and transporting the developer to a developing zone;

said developer carrying member having at least a surface formed of a material containing a resin; and said positive-chargeable toner comprising a binder resin, a colorant and a charge control agent, wherein;

said binder resin contains a styrene copolymer and has an acid value of from 0.5 to 50.0 mg KOH/g; and said charge control agent has an imidazole derivative represented by the following Formula (1):

(1)

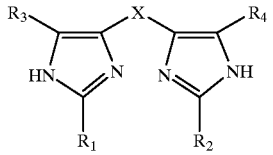

wherein $R_1$, $R_2$, $R_3$ and $R_4$ each represent a substituent selected from the group consisting of a hydrogen atom, an alkyl group, an aralkyl group and an aryl group, which are the same or different from one another and may further be substituted with a substituent; and X represents a connecting group selected from the group consisting of a phenylene group, a propenylene group, a vinylene group, an alkylene group and —$CR_5R_6$—, where $R_5$ and $R_6$ each represent a substituent selected from the group consisting of a hydrogen atom, an alkyl group, an aralkyl group and an aryl group.

68. The apparatus unit according to claim 67, wherein said binder resin has an acid value of from 0.5 mg KOH/g to 30.0 mg KOH/g.

69. The apparatus unit according to claim 67, wherein said binder resin has an acid value of from 0.5 mg KOH/g to 20.0 mg KOH/g.

70. The apparatus unit according to claim 67, wherein said binder resin has an acid value of from more than 5 mg KOH/g to not more than 20.0 mg KOH/g.

71. The apparatus unit according to claim 67, wherein said styrene copolymer contains at least a styrene monomer unit and a carboxyl group or acid anhydride group-containing monomer unit.

72. The apparatus unit according to claim 67, wherein said styrene copolymer contains at least a styrene monomer unit, a carboxyl group or acid anhydride group-containing monomer unit and other vinyl monomer unit.

73. The apparatus unit according to claim 71, wherein said carboxyl group or acid anhydride group-containing monomer is selected from the group consisting of acrylic acid, an α-alkyl derivative of acrylic acid, a β-alkyl derivative of acrylic acid, an unsaturated dicarboxylic acid, a monoester derivative of an unsaturated dicarboxylic acid and an anhydride of an unsaturated dicarboxylic acid.

74. The apparatus unit according to claim 71, wherein said carboxyl group or acid anhydride group-containing monomer is a monoester derivative of an unsaturated dicarboxylic acid.

75. The apparatus unit according to claim 74, wherein said monoester derivative of an unsaturated dicarboxylic acid is selected from the group consisting of a monoester of an α,β-unsaturated dicarboxylic acid and a monoester of an alkenyldicarboxylic acid.

76. The apparatus unit according to claim 71, wherein said binder resin is synthesized by the use of said carboxyl group or acid anhydride group-containing monomer in an amount of from 0.1 part by weight to 20 parts by weight based on 100 parts by weight of the whole monomers constituting the binder resin.

77. The apparatus unit according to claim 71, wherein said styrene monomer is selected from the group consisting of styrene and a styrene derivative.

78. The apparatus unit according to claim 77, wherein said styrene derivative is selected from the group consisting of o-methylstyrene, m-methylstyrene, p-methylstyrene, p-methoxystyrene, p-phenylstyrene, p-chlorostyrene, 3,4-dichlorostyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene and p-n-dodecylstyrene.

79. The apparatus unit according to claim 72, wherein said other vinyl monomer comprises an acrylate.

80. The apparatus unit according to claim 67, wherein said styrene copolymer contains at least a styrene monomer unit and a carboxyl group or acid anhydride group-containing monomer unit, and the carboxylic acid group, acid anhydride group or carboxylate ester moiety in the styrene copolymer has been saponified by alkali treatment.

81. The apparatus unit according to claim 67, wherein said binder resin comprises a resin composition which is a mixture of a high-molecular-weight polymer component and a low-molecular-weight polymer component.

82. The apparatus unit according to claim 81, wherein said high-molecular-weight polymer component and said low-molecular-weight polymer component each contain the styrene copolymer in an amount not less than 65% by weight.

83. The apparatus unit according to claim 81, wherein said resin composition is synthesized by (i) a solution blend method in which a high-molecular-weight polymer component synthesized by solution polymerization or suspension polymerization and a low-molecular-weight polymer component synthesized by solution polymerization are mixed in the state of a solution without solvent removal, followed by solvent removal, (ii) a dry blend method in which a high-molecular-weight polymer component synthesized by solution polymerization or suspension polymerization and a low-molecular-weight polymer component synthesized by solution polymerization are subjected to solvent removal and thereafter melt-kneaded or (iii) a two-stage polymerization method in which a low-molecular-weight polymer synthesized by solution polymerization is dissolved in monomers for constituting a high-molecular-weight polymer component to polymerize the monomers to synthesize the high-molecular-weight polymer.

84. The apparatus unit according to claim 67, wherein said binder resin contains whole styrene resins including said styrene copolymer in an amount of not less than 60% by weight based on the weight of the whole binder resin.

85. The apparatus unit according to claim 67, wherein said positive-chargeable toner further comprises a wax.

86. The apparatus unit according to claim 85, wherein said wax has a melting point of from 70° C. to 165° C.

87. The apparatus unit according to claim 85, wherein said wax is contained in the positive-chargeable toner in an amount of from 0.5 part by weight to 10 parts by weight based on 100 parts by weight of the binder resin.

88. The apparatus unit according to claim 67, wherein said imidazole derivative comprises a compound represented by the following Formula (2):

(2)

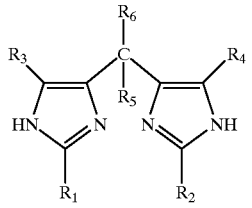

wherein $R_1$ and $R_2$ each represent a substituent selected from the group consisting of an alkyl group having 5 to 20 carbon atoms, an aralkyl group having 5 to 20 carbon atoms and an aryl group having 6 to 20 carbon atoms, which are the same or different from each other and may each be substituted with a substituent; and $R_3$, $R_4$, $R_5$ and $R_6$ each represent a substituent selected from the group consisting of a hydrogen atom, an alkyl group, an aralkyl group and an aryl group, which are the same or different from one another and may each be substituted with a substituent.

89. The apparatus unit according to claim 67, wherein said imidazole derivative comprises a compound represented by the following Formula (3):

(3)

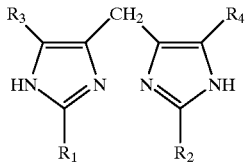

wherein $R_1$ and $R_2$ each represent a substituent selected from the group consisting of an alkyl group having 5 to 20 carbon atoms, an aralkyl group having 5 to 20 carbon atoms and an aryl group having 6 to 20 carbon atoms, which are the same or different from each other and may each be substituted with a substituent; and $R_3$ and $R_4$ each represent a substituent selected from the group consisting of a hydrogen atom, an alkyl group, an aralkyl group and an aryl group, which are the same or different from each other and may each be substituted with a substituent.

90. The apparatus unit according to claim 67, wherein said imidazole derivative is contained in the positive-chargeable toner in an amount of from 0.01 part by weight to 20.0 parts by weight based on 100 parts by weight of the binder resin.

91. The apparatus unit according to claim 67, wherein said positive-chargeable toner is a non-magnetic toner containing a pigment or a dye as the colorant.

92. The apparatus unit according to claim 67, wherein said positive-chargeable toner is a magnetic toner containing a magnetic material as the colorant.

93. The apparatus unit according to claim 92, wherein said magnetic material is contained in the positive-chargeable toner in an amount of from 10 parts by weight to 200 parts by weight based on 100 parts by weight of the binder resin.

94. The apparatus unit according to claim 92, wherein said magnetic material contains silicon element in an amount of from 0.05% by weight to 10% by weight based on the weight of the magnetic material.

95. The apparatus unit according to claim 67, wherein said positive-chargeable toner further comprises a fine silica powder externally added.

96. The apparatus unit according to claim 67, wherein said positive-chargeable toner has a weight-average particle diameter of from 3 $\mu$m to 10 $\mu$m.

97. The apparatus unit according to claim 91, wherein said non-magnetic toner is used as a one-component non-magnetic developer.

98. The apparatus unit according to claim 92, wherein said magnetic toner is used as a one-component magnetic developer.

99. The apparatus unit according to claim 67, wherein said developer carrying member is a cylindrical sleeve formed of a material containing a resin.

100. The apparatus unit according to claim 67, wherein said developer carrying member has a substrate and a coat layer containing a resin formed on the substrate.

101. The apparatus unit according to claim 100, wherein said coat layer further contains at least one member selected from the group consisting of a conductive material, a filler, and a solid lubricant.

102. The apparatus unit according to claim 67, wherein said electrostatic latent image bearing member is an electrophotographic photosensitive member.

* * * * *

UNITED STATES PATENT AND TRADEMARK OFFICE

CERTIFICATE OF CORRECTION

PATENT NO. : 6,020,102
DATED : February 1, 2000
INVENTOR(S) : Masami Fujimoto et al.

It is certified that error appears in the above-identified patent and that said Letters Patent is hereby corrected as shown below:

Column 1
Line 65, "variety" should read --a wide variety--.

Column 3
Line 48, "can not" should read --cannot--.

Column 4
Line 47, "can" should read --can--.

Column 5
Line 28, "can not" should read --cannot--;
Line 49, "wherein;" should read --wherein:--.

Column 6
Line 9, "of;" should read --of:--;
Line 20, "wherein;" should read --wherein:--;
Line 49, "comprising;" should read --comprising:--;
Line 62, "wherein;" should read --wherein:--.

Column 8
Line 4, "agent." should read --agent:--.

Column 9
Line 31, "can not" should read --cannot--.

Column 13
Line 49, "by" should read --by:--.

Column 14
Line 5, "are" should read --are:--.

Column 16
Line 3, "(A);" should read -- (A) :--;
Line 14, "(B)" should read -- (B) :--.

UNITED STATES PATENT AND TRADEMARK OFFICE

CERTIFICATE OF CORRECTION

PATENT NO. : 6,020,102
DATED : February 1, 2000
INVENTOR(S) : Masami Fujimoto et al.

It is certified that error appears in the above-identified patent and that said Letters Patent is hereby corrected as shown below:

Column 17
Line 35, "mPa.s" should read --mPa·s--.

Column 18
Line 23, "includes" should read --include--;
Line 53, "(3)." should read -- (3) :--.

Column 19
Line 1, "having 5" should read --having 7--;
Line 61, "atoms," should read --atoms or 7 carbon atoms,--.

Column 20
Line 30, "few" should read --a few--.

Column 26
Line 53, "fogs" should read --fog.--;
Line 61, "an" should read --a--.

Column 29
Line 63, "contain" should read --contains--.

Column 31
Line 4, "itself" should read --themselves--;
Line 28, "and or" should read --and/or--.

Column 32
Line 22, "non magnetic" should read --non-magnetic--.

UNITED STATES PATENT AND TRADEMARK OFFICE

CERTIFICATE OF CORRECTION

PATENT NO. : 6,020,102
DATED : February 1, 2000
INVENTOR(S) : Masami Fujimoto et al.

It is certified that error appears in the above-identified patent and that said Letters Patent is hereby corrected as shown below:

Column 47
Line 47, "wherein;" should read --wherein:--.

Column 48
Line T2, "After 10,000 sheets" should read
--After 1,000 sheets--; "After 5,000 sh." should read
--After 1,000 sh.--; and "After 5,000 sh." should read
--After 1,000 sh.--.

Column 50,
Line 30, "5" should read --7--;
Line 52, "5" should read --7--.

Column 51,
Line 18, "of;" should read --of:--;
Line 29, "wherein;" should read --wherein:--.

Column 53
Line 39, "5" should read --7--;
Line 62, "5" should read --7--.

Column 54
Line 50, "ing;" should read --ing:--;
Line 62, "wherein" should read --wherein:--.

Column 56
Line 66, "5" should read --7--.

UNITED STATES PATENT AND TRADEMARK OFFICE

CERTIFICATE OF CORRECTION

PATENT NO. : 6,020,102
DATED : February 1, 2000
INVENTOR(S) : Masami Fujimoto et al.

It is certified that error appears in the above-identified patent and that said Letters Patent is hereby corrected as shown below:

Column 57
Line 21, "5" should read --7--.

Signed and Sealed this

Twenty-sixth Day of June, 2001

*Attest:*

Nicholas P. Godici

*Attesting Officer*

NICHOLAS P. GODICI
*Acting Director of the United States Patent and Trademark Office*